US011619114B2

(12) United States Patent
Saeed et al.

(10) Patent No.: US 11,619,114 B2
(45) Date of Patent: Apr. 4, 2023

(54) ENTERING A LATERAL BRANCH OF A WELLBORE WITH AN ASSEMBLY

(71) Applicants: Saudi Arabian Oil Company, Dhahran (SA); WIRELESS INSTRUMENTATION SYSTEMS AS, Trondheim (NO)

(72) Inventors: Abubaker Saeed, Dhahran (SA); Jarl André Fellinghaug, Leinstrand (NO); Henrik Wanvik Clayborough, Trondheim (NO); Sergey Kulyakhtin, Trondheim (NO); Anton Kulyakhtin, Trondheim (NO); Stian Marius Hansen, Trondheim (NO)

(73) Assignees: Saudi Arabian Oil Company, Dhahran (SA); WIRELESS INSTRUMENTATION SYSTEMS AS, Trondheim (NO)

( * ) Notice: Subject to any disclaimer, the term of this patent is extended or adjusted under 35 U.S.C. 154(b) by 0 days.

(21) Appl. No.: 17/231,359

(22) Filed: Apr. 15, 2021

(65) Prior Publication Data

US 2022/0333461 A1 Oct. 20, 2022

(51) Int. Cl.
*E21B 7/06* (2006.01)
*E21B 41/00* (2006.01)

(52) U.S. Cl.
CPC ..... *E21B 41/0035* (2013.01); *E21B 7/06* (2013.01)

(58) Field of Classification Search
CPC ..... E21B 41/0035; E21B 41/00; E21B 7/06
See application file for complete search history.

(56) References Cited

U.S. PATENT DOCUMENTS 2,643,723 A 6/1953 Lynes
3,175,618 A 3/1965 Lang et al.
3,448,305 A 6/1969 Raynal et al.
(Continued)

FOREIGN PATENT DOCUMENTS

CN 101592475 12/2009
CN 201496028 6/2010
(Continued)

OTHER PUBLICATIONS

Bao et al., "Recent development in the distributed fiber optic acoustic and ultrasonic detection," Journal of Lightwave Technology, Aug. 15, 2017, 35:16 (3256-3267), 12 pages.
(Continued)

*Primary Examiner* — Taras P Bemko
(74) *Attorney, Agent, or Firm* — Fish & Richardson P.C.

(57) ABSTRACT

An assembly and a method for entering a lateral branch of a main wellbore through a lateral window with an assembly are described. The assembly includes an arm coupled to a body. The arm positions the body to enter the lateral branch. The assembly includes an actuator to actuate the arm relative to the body. The assembly includes a first sensor, a second sensor, and a controller. The first sensor senses a condition of the arm and transmit the condition of the arm to the controller. The second sensor senses when the assembly is located in the main wellbore or the lateral branch transmits the location to the controller. Responsive to either the first signal or the second signal, the controller actuates the arm relative to the body to position the body to enter the lateral window and determines when the assembly has entered the lateral branch.

22 Claims, 10 Drawing Sheets

(56) References Cited

U.S. PATENT DOCUMENTS

| | | | |
|---|---|---|---|
| 3,558,936 | A | 1/1971 | Horan |
| 3,663,845 | A | 5/1972 | Apstein |
| 3,916,999 | A | 11/1975 | Ellis et al. |
| 3,918,520 | A | 11/1975 | Hutchison |
| 3,970,877 | A | 7/1976 | Russell et al. |
| 4,387,318 | A | 6/1983 | Kolm et al. |
| 4,536,674 | A | 8/1985 | Schmidt |
| 4,685,523 | A | 8/1987 | Paschal, Jr. et al. |
| 5,092,176 | A | 3/1992 | Buttram et al. |
| 5,113,379 | A | 5/1992 | Scherbatskoy |
| 5,150,619 | A | 9/1992 | Turner |
| 5,224,182 | A | 6/1993 | Murphy et al. |
| 5,301,760 | A | 4/1994 | Graham |
| 5,317,223 | A | 5/1994 | Kiesewetter et al. |
| 5,375,622 | A | 12/1994 | Houston |
| 5,566,762 | A | 10/1996 | Braddick et al. |
| 5,613,555 | A | 3/1997 | Sorem et al. |
| 5,708,500 | A | 1/1998 | Anderson |
| 5,892,860 | A | 4/1999 | Maron et al. |
| 5,965,964 | A | 10/1999 | Skinner et al. |
| 5,975,205 | A | 11/1999 | Carisella |
| 6,044,906 | A | 4/2000 | Saltel |
| 6,068,015 | A | 5/2000 | Pringle |
| 6,082,455 | A | 7/2000 | Pringle et al. |
| 6,193,079 | B1 | 2/2001 | Weimer |
| 6,209,652 | B1 | 4/2001 | Portman et al. |
| 6,349,768 | B1 | 2/2002 | Leising |
| 6,504,258 | B2 | 1/2003 | Schultz et al. |
| 6,578,638 | B2 | 6/2003 | Guillory et al. |
| 6,588,266 | B2 | 7/2003 | Tubel et al. |
| 6,728,165 | B1 | 4/2004 | Roscigno et al. |
| 6,768,214 | B2 | 7/2004 | Schultz et al. |
| 6,779,601 | B2 | 8/2004 | Wilson |
| 6,913,079 | B2 | 7/2005 | Tubel |
| 6,920,085 | B2 | 7/2005 | Finke et al. |
| 7,199,480 | B2 | 4/2007 | Fripp et al. |
| 7,224,077 | B2 | 5/2007 | Allen |
| 7,242,103 | B2 | 7/2007 | Tips |
| 7,249,805 | B2 | 7/2007 | Cap |
| 7,345,372 | B2 | 3/2008 | Roberts et al. |
| 7,397,388 | B2 | 7/2008 | Huang et al. |
| 7,410,003 | B2 | 8/2008 | Ravensbergen et al. |
| 7,668,411 | B2 | 2/2010 | Davies et al. |
| 7,847,421 | B2 | 12/2010 | Gardner et al. |
| 7,906,861 | B2 | 3/2011 | Guerrero et al. |
| 7,946,341 | B2 | 5/2011 | Hartog et al. |
| 7,980,309 | B2 | 7/2011 | Crawford |
| 8,047,232 | B2 | 11/2011 | Bernitsas |
| 8,258,644 | B2 | 9/2012 | Kaplan |
| 8,408,064 | B2 | 4/2013 | Hartog et al. |
| 8,421,251 | B2 | 4/2013 | Pabon et al. |
| 8,426,988 | B2 | 4/2013 | Hay |
| 8,493,556 | B2 | 7/2013 | Li et al. |
| 8,564,179 | B2 | 10/2013 | Ochoa et al. |
| 8,604,634 | B2 | 12/2013 | Pabon et al. |
| 8,638,002 | B2 | 1/2014 | Lu |
| 8,648,480 | B1 | 2/2014 | Liu et al. |
| 8,681,000 | B2 | 3/2014 | August et al. |
| 8,786,113 | B2 | 7/2014 | Tinnen et al. |
| 8,916,983 | B2 | 12/2014 | Marya et al. |
| 8,925,649 | B1 | 1/2015 | Wiebe et al. |
| 8,941,384 | B2 | 1/2015 | Prammer |
| 8,948,550 | B2 | 2/2015 | Li et al. |
| 9,026,376 | B2 | 5/2015 | Volker et al. |
| 9,091,144 | B2 | 7/2015 | Swanson et al. |
| 9,106,159 | B1 | 8/2015 | Wiebe et al. |
| 9,130,161 | B2 | 9/2015 | Nair et al. |
| 9,140,815 | B2 | 9/2015 | Lopez et al. |
| 9,170,149 | B2 | 10/2015 | Hartog et al. |
| 9,239,043 | B1 | 1/2016 | Zeas |
| 9,321,222 | B2 | 4/2016 | Childers et al. |
| 9,322,389 | B2 | 4/2016 | Tosi |
| 9,499,460 | B2 | 11/2016 | Kawamura et al. |
| 9,574,420 | B2 | 2/2017 | Hall et al. |
| 9,581,489 | B2 | 2/2017 | Skinner |
| 9,599,460 | B2 | 3/2017 | Wang et al. |
| 9,599,505 | B2 | 3/2017 | Lagakos et al. |
| 9,617,847 | B2 | 4/2017 | Jaaskelainen et al. |
| 9,638,671 | B2 | 5/2017 | Borigo et al. |
| 9,759,556 | B2 | 9/2017 | Davis et al. |
| 9,784,077 | B2 | 10/2017 | Gorrara |
| 9,803,976 | B2 | 10/2017 | Simonetti et al. |
| 10,115,942 | B2 | 10/2018 | Qiao et al. |
| 10,209,383 | B2 | 2/2019 | Barfoot et al. |
| 10,253,615 | B2 | 4/2019 | Hunter et al. |
| 10,367,434 | B2 | 7/2019 | Ahmad |
| 10,934,814 | B2 | 3/2021 | Arsalan et al. |
| 2002/0043404 | A1 | 4/2002 | Trueman et al. |
| 2006/0042792 | A1 | 3/2006 | Connell |
| 2006/0086498 | A1 | 4/2006 | Wetzel et al. |
| 2007/0012437 | A1 | 1/2007 | Clingman et al. |
| 2007/0181304 | A1 | 8/2007 | Rankin et al. |
| 2008/0048455 | A1 | 2/2008 | Carney |
| 2008/0100828 | A1 | 5/2008 | Cyr et al. |
| 2008/0277941 | A1 | 11/2008 | Bowles |
| 2008/0296067 | A1 | 12/2008 | Haughom |
| 2009/0107725 | A1 | 4/2009 | Christy et al. |
| 2009/0166045 | A1 | 7/2009 | Wetzel et al. |
| 2010/0164231 | A1 | 7/2010 | Tsou |
| 2010/0308592 | A1 | 12/2010 | Frayne |
| 2011/0049901 | A1 | 3/2011 | Tinnen |
| 2011/0088462 | A1 | 4/2011 | Samson et al. |
| 2011/0273032 | A1 | 11/2011 | Lu |
| 2012/0018143 | A1 | 1/2012 | Lembcke |
| 2012/0211245 | A1 | 8/2012 | Fuhst et al. |
| 2012/0292915 | A1 | 11/2012 | Moon |
| 2013/0068481 | A1 | 3/2013 | Zhou |
| 2013/0091942 | A1 | 4/2013 | Samson et al. |
| 2013/0119669 | A1 | 5/2013 | Murphree |
| 2013/0167628 | A1 | 7/2013 | Hull et al. |
| 2013/0200628 | A1 | 8/2013 | Kane |
| 2013/0227940 | A1 | 9/2013 | Greenblatt |
| 2014/0167418 | A1 | 6/2014 | Hiejima |
| 2014/0175800 | A1 | 6/2014 | Thorp |
| 2014/0284937 | A1 | 9/2014 | Dudley et al. |
| 2014/0311737 | A1 | 10/2014 | Bedouet et al. |
| 2015/0053009 | A1 | 2/2015 | Yan et al. |
| 2015/0060083 | A1 | 3/2015 | Romer et al. |
| 2015/0114127 | A1 | 4/2015 | Barfoot et al. |
| 2015/0318920 | A1 | 11/2015 | Johnston |
| 2016/0168957 | A1 | 6/2016 | Tubel |
| 2016/0177659 | A1 | 6/2016 | Voll et al. |
| 2016/0273947 | A1 | 9/2016 | Mu et al. |
| 2017/0033713 | A1 | 2/2017 | Petroni |
| 2017/0075029 | A1 | 3/2017 | Cuny et al. |
| 2017/0235006 | A1 | 8/2017 | Ellmauthaler et al. |
| 2017/0260846 | A1 | 9/2017 | Jin et al. |
| 2018/0045543 | A1 | 2/2018 | Farhadiroushan et al. |
| 2018/0052041 | A1 | 2/2018 | Yaman et al. |
| 2018/0155991 | A1 | 6/2018 | Arsalan et al. |
| 2018/0274311 | A1 | 9/2018 | Zsolt |
| 2018/0351480 | A1 | 12/2018 | Ahmad |
| 2019/0025095 | A1 | 1/2019 | Steel |
| 2019/0049054 | A1 | 2/2019 | Gunnarsson |
| 2019/0055792 | A1 | 2/2019 | Sui et al. |
| 2019/0128113 | A1 | 5/2019 | Ross et al. |
| 2019/0253003 | A1 | 8/2019 | Ahmad |
| 2019/0253004 | A1 | 8/2019 | Ahmad |
| 2019/0253005 | A1 | 8/2019 | Ahmad |
| 2019/0253006 | A1 | 8/2019 | Ahmad |
| 2019/0376371 | A1 | 12/2019 | Arsalan |
| 2020/0270983 | A1 | 8/2020 | Hallunbaek et al. |

FOREIGN PATENT DOCUMENTS

| | | |
|---|---|---|
| CN | 102471701 | 5/2012 |
| CN | 101488805 | 8/2012 |
| CN | 103913186 | 7/2014 |
| CN | 105043586 | 11/2015 |
| CN | 107144339 | 9/2017 |
| CN | 206496768 | 9/2017 |
| CN | 105371943 | 6/2018 |
| CN | 108534910 | 9/2018 |
| DE | 202012103729 | 10/2012 |

(56) References Cited

FOREIGN PATENT DOCUMENTS

| | | |
|---|---|---|
| EP | 0380148 | 8/1990 |
| GB | 2218721 | 11/1989 |
| JP | 2010156172 | 7/2010 |
| WO | WO 1993006331 | 4/1993 |
| WO | WO 2009046709 | 4/2009 |
| WO | WO 2014116458 | 7/2014 |
| WO | WO 2015073018 | 5/2015 |
| WO | WO 2016111849 | 7/2016 |
| WO | WO 2016130620 | 8/2016 |
| WO | WO 2017146593 | 8/2017 |
| WO | WO 2018125071 | 7/2018 |
| WO | WO 2018145215 | 8/2018 |

OTHER PUBLICATIONS

Bybee et al., "Through-Tubing Completions Maximize Production," SPE-0206-0057, Society of Petroleum Engineers (SPE), Drilling and Cementing Technology, JPT, Feb. 2006, 2 pages.
Chen et al., "Distributed acoustic sensor based on two-mode fiber," Optics Express 25399, Optics Express, Sep. 2018, 26:19, 9 pages.
Cox et al., "Realistic Assessment of Proppant Pack Conductivity for Material Section," SPE-84306-MS, Society of Petroleum Engineers (SPE), presented at the Annual Technical Conference, Oct. 5-8, 2003, 12 pages.
Fornarelli et al., "Flow patterns and heat transfer around six in-line circular cylinders at low Reynolds number," JP Journal of Heat and Mass Transfer, Pushpa Publishing House, Allahabad, India, Feb. 2015, 11:1 (1-28), 28 pages.
Gillard et al., "A New Approach to Generating Fracture Conductivity," SPE-135034-MS, Society of Petroleum Engineers (SPE), presented at the SPE Annual Technical Conference and Exhibition, Sep. 19-22, 2010, 14 pages.
Gomaa et al., "Computational Fluid Dynamics Applied To Investigate Development and Optimization of Highly Conductive Channels within the Fracture Geometry," SPE-179143-MS, Society of Petroleum Engineers (SPE), SPE Production & Operations, 32:04, Nov. 2017, 12 pages.
Gomaa et al., "Improving Fracture Conductivity by Developing and Optimizing a Channels Within the Fracture Geometry: CFD Study," SPE-178982-MS, Society of Petroleum Engineers (SPE), SPE International Conference and Exhibition on Formation Damage Control, Feb. 24-26, 2016, 25 pages.
Govardhan et al., "Critical mass in vortex-induced vibration of a cylinder," European Journal of Mechanics B/Fluids, Jan.-Feb. 2004, 23:1 (17-27), 11 pages.
Huthwaite, "Evaluation of inversion approaches for guided wave thickness mapping," Proceedings of the Royal Society A, Mar. 2014, 470:20140063, 28 pages.
Huthwaite, "Improving accuracy through density correction in guided wave tomography," Proceedings of the Royal Society A, Jan. 2016, 472:20150832, 25 pages.
Juarez and Taylor, "Field test of a distributed fiber-optic intmsion sensor system for long perimeters," Applied Optics, Apr. 10, 2007, 46:11 (1968-1971), 4 pages.
Keiser, "Optical fiber communications," McGraw Hill, 2008, 26-57, 16 pages.
Kern et al., "Propping Fractures With Aluminum Particles," SPE-1573-G-PA, Society of Petroleum Engineers (SPE), Journal of Per. Technology, Jun. 1961, 13:6 (583-589), 7 pages.
Meyer et al., "Theoretical Foundation and Design Formulae for Channel and Pillar Type Propped Fractures—A Method to Increase Fracture Conductivity," SPE-170781-MS, Society Of Petroleum Engineers (SPE), presented at the SPE Annual Technical Conference and Exhibition, Amsterdam, The Netherlands, Oct. 27-29, 2014, 25 pages.
Palisch et al., "Determining Realistic Fracture Conductivity and Understanding its Impact on Well Performance—Theory and Field Examples," SPE-106301-MS, Society of Petroleum Engineers (SPE), presented at the 2007 SPE Hydraulic Fracturing Technology Conference, College Station, Texas, Jan. 29-31, 2007, 13 pages.
petrowiki.spe.org (online), "Scale Problems in Production," available on or before Jan. 15, 2018, retrieved on Feb. 16, 2021, retrieved from URL <https://petrowiki.spe.org/Scale_problems_in_production>, 15 pages.
Poollen et al., "Hydraulic Fracturing—Fracture Flow Capacity vs Well Productivity," SPE-890-G, Society of Petroleum Engineers (SPE), presented at 32nd Annual Fall Meeting of Society of Petroleum Engineers, Oct. 6-9, 1957, published as Petroleum Transactions AIME 213, 1958, 5 pages.
Poollen, "Productivity vs Permeability Damage in Hydraulically Produced Fractures," Paper 906-2-G, American Petroleum Institute, presented at Drilling and Production Practice, Jan. 1, 1957, 8 pages.
Qin et al., "Signal-to-Noise Ratio Enhancement Based on Empirical Mode Decomposition in Phase-Sensitive Optical Time Domain Reflectometry Systems," Sensors, MDPI, Aug. 14, 2017, 17:1870, 10 pages.
Rao et al., "Guided Wave Tomography Based on Full Waveform Inversion," IEEE Transactions on Ultrasonics, Ferroelectrics and Frequency Control, May 2016, 63:5, 9 pages.
Rao et al., "Guided Wave Tomography Based on Full Waveform Inversion," Manuscript, The School of Mechanical and Aerospace Engineering, Nanyang Technology University, Feb. 26, 2016, 33 pages.
Saeed et al., "Innovative Permanent Down-Hole Scale and Corrosion Monitoring System Using Ultrasound Guided Waves Technology," SPE-198609-MS, Society of Petroleum Engineers (SPE), presented at the SPE Gas & Oil Technology Showcase and Conference, Dubai, UAE, Oct. 21-23, 2019, 10 pages.
Stalford et al., "Literature Survey and Background Studies Report (Task V)," Document No. 10121.4504.01.01, Intelligent Casing-Intelligent Formation Telemetry (ICIFT) System, Research Partnership of Secure Energy for America (RPSEA), Jul. 15, 2014, 90 pages.
Tinsley and Williams, "A new method for providing increased fracture conductivity and improving stimulation results," SPE-4676-PA, Society of Petroleum Engineers (SPE), Journal of Petroleum Technology, Nov. 1975, 27:11 (1319-1325), 7 pages.
Vincent, "Examining Our Assumptions—Have Oversimplifications Jeopardized our Ability To Design Optimal Fracture Treatments," SPE-119143-MS, Society of Petroleum Engineers (SPE), presented at the SPE Hydraulic Fracturing Technology Conference, the Woodlands, Texas, Jan. 19-21, 2009, 51 pages.
Vincent, "Five Things You Didn't Want to Know about Hydraulic Fractures," ISRM-ICHF-2013-045, presented at the International Conference for Effective and Sustainable Hydraulic Fracturing: An ISRM specialized Conference, May 20-22, 2013, 14 pages.
Vysloukh, "Chapter 8: Stimulated Raman Scattering," in Nonlinear Fiber Optics, 1990, 298-302, 5 pages.
Walker et al., "Proppants, We Still Don't Need No Proppants—A Perspective of Several Operators," SPE-38611-MS, Society of Petroleum Engineers (SPE), presented at the SPE Annual Technical Conference and Exhibition, San Antonio, Texas, Sep. 27-30, 1995, 8 pages.
Wang et al., "Rayleigh scattering in few-mode optical fibers," Scientific reports, Oct. 2016, 6:35844 (1-8), 8 pages.
Williams, "A new method for providing increased fracture conductivity and improving stimulation results," SPE-4676-PA, Journal of Petroleum Technology, vol. 27, No. 11, MO 1975, (1319-1325).
Yamate et al., "Optical sensors for the exploration of oil and gas," Journal of Lightwave Technology, Aug. 15, 2017, 35:16 (3538-3545), 8 pages.

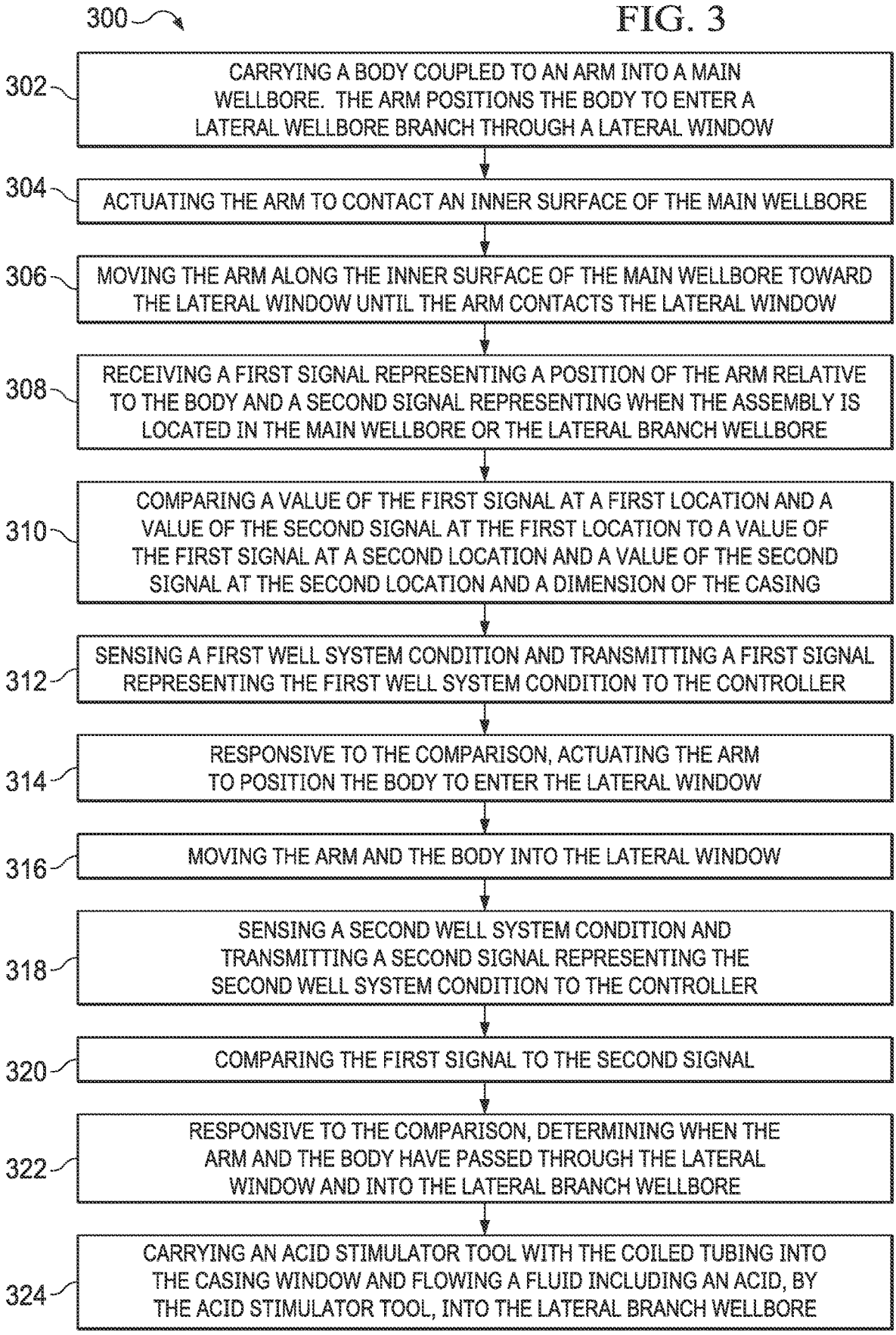
300
FIG. 3
302
CARRYING A BODY COUPLED TO AN ARM INTO A MAIN WELLBORE. THE ARM POSITIONS THE BODY TO ENTER A LATERAL WELLBORE BRANCH THROUGH A LATERAL WINDOW
304
ACTUATING THE ARM TO CONTACT AN INNER SURFACE OF THE MAIN WELLBORE
306
MOVING THE ARM ALONG THE INNER SURFACE OF THE MAIN WELLBORE TOWARD THE LATERAL WINDOW UNTIL THE ARM CONTACTS THE LATERAL WINDOW
308
RECEIVING A FIRST SIGNAL REPRESENTING A POSITION OF THE ARM RELATIVE TO THE BODY AND A SECOND SIGNAL REPRESENTING WHEN THE ASSEMBLY IS LOCATED IN THE MAIN WELLBORE OR THE LATERAL BRANCH WELLBORE
310
COMPARING A VALUE OF THE FIRST SIGNAL AT A FIRST LOCATION AND A VALUE OF THE SECOND SIGNAL AT THE FIRST LOCATION TO A VALUE OF THE FIRST SIGNAL AT A SECOND LOCATION AND A VALUE OF THE SECOND SIGNAL AT THE SECOND LOCATION AND A DIMENSION OF THE CASING
312
SENSING A FIRST WELL SYSTEM CONDITION AND TRANSMITTING A FIRST SIGNAL REPRESENTING THE FIRST WELL SYSTEM CONDITION TO THE CONTROLLER
314
RESPONSIVE TO THE COMPARISON, ACTUATING THE ARM TO POSITION THE BODY TO ENTER THE LATERAL WINDOW
316
MOVING THE ARM AND THE BODY INTO THE LATERAL WINDOW
318
SENSING A SECOND WELL SYSTEM CONDITION AND TRANSMITTING A SECOND SIGNAL REPRESENTING THE SECOND WELL SYSTEM CONDITION TO THE CONTROLLER
320
COMPARING THE FIRST SIGNAL TO THE SECOND SIGNAL
322
RESPONSIVE TO THE COMPARISON, DETERMINING WHEN THE ARM AND THE BODY HAVE PASSED THROUGH THE LATERAL WINDOW AND INTO THE LATERAL BRANCH WELLBORE
324
CARRYING AN ACID STIMULATOR TOOL WITH THE COILED TUBING INTO THE CASING WINDOW AND FLOWING A FLUID INCLUDING AN ACID, BY THE ACID STIMULATOR TOOL, INTO THE LATERAL BRANCH WELLBORE

ENTERING A LATERAL BRANCH OF A WELLBORE WITH AN ASSEMBLY

TECHNICAL FIELD

This disclosure relates to a wellbore, for example, through which hydrocarbons are produced.

BACKGROUND

Wellbores in an oil and gas well are filled with both liquid and gaseous phases of various fluids and chemicals including water, oils, and hydrocarbon gases. A wellbore can include a main wellbore extending from a surface of the Earth downward into the formations of the Earth containing the water, oils, and hydrocarbons. A casing can be installed in the main wellbore to seal the main wellbore from the formations of the Earth. The wellbore can include a lateral branch fluidically coupled to the main wellbore. In some cases, a portion of the lateral branch includes a casing similar to the main wellbore. In other cases, the lateral branch is an open hole to allow the water, oils, and hydrocarbon gases to flow in the lateral branch and subsequently into the main wellbore to the surface.

SUMMARY

This disclosure describes technologies related to entering a lateral branch of a wellbore through a lateral window with an assembly. Implementations of the present disclosure include an assembly to be disposed in a well system. The well system includes a main wellbore with a casing. The main wellbore is coupled to a lateral branch wellbore. The lateral branch wellbore is coupled to the main wellbore by an opening. The assembly includes a body. The assembly includes an arm coupled to the body. The arm positions the body to enter the lateral branch wellbore from the main wellbore through the opening. In some implementations, the main wellbore includes a casing, the lateral branch wellbore includes an open hole, and the opening is a lateral window.

The assembly includes an actuator sub-assembly coupled to the arm and the body. The actuator sub-assembly actuates the arm relative to the body. In some implementations, the actuator sub-assembly includes a pivot joint coupling the arm to the body. The pivot joint allows the arm to pivot relative to the body about the pivot joint. In some implementations, the actuator sub-assembly includes a connector rod coupled to the arm and the body. The connector rod shifts the arm relative to the body about the pivot joint. In some implementations, the actuator sub-assembly includes a magnetic coupling operatively coupled to the connector rod. In some implementations, the actuator sub-assembly includes a linkage rod coupled to the connector rod and the magnetic coupling. The linkage rod actuates the connector rod responsive to a movement of the magnetic coupling.

In some implementations, a swivel is coupled to the actuator sub-assembly and the body. The swivel rotates the actuator sub-assembly and the arm about the body.

The assembly includes a control sub-assembly coupled to the body. The control sub-assembly is operatively coupled to the actuator sub-assembly. The control sub-assembly includes a first sensor to sense a condition of the arm and transmit a first signal representing the condition of the arm. The control sub-assembly includes a second sensor to sense when the assembly is located in the main wellbore or the lateral branch wellbore and transmit a second signal representing when the assembly is located in the main wellbore or the lateral branch wellbore. In some implementations, the second sensor includes an inductive sensor.

The control sub-assembly includes a controller. The controller receives the first signal. The controller receives the second signal. Responsive to either the first signal or the second signal, the controller actuates the arm relative to the body to position the body to enter the opening. Responsive to either the first signal or the second signal, the controller determines when the assembly has entered the open hole through the opening.

In some implementations, the control sub-assembly further includes an accelerometer. The accelerometer senses an orientation, a position, and a motion of the assembly. Where the control sub-assembly further includes an accelerometer, the controller further receives a value of a first condition of the assembly from the accelerometer at a first location in the well system, stores the value of the first condition in the non-transitory computer-readable storage medium, receives a value of a second condition of the assembly from the accelerometer at a second location in the well system, stores the value of the second condition in the non-transitory computer-readable storage medium, compares the value of the first condition of the assembly at the first location to the value of the second condition of the assembly at the second location, and responsive to the comparison, generates a command signal to operate the actuator sub-assembly to position or orient the assembly in the wellbore in the well system.

In some implementations, the control sub-assembly further includes one or more computer processors and a non-transitory computer-readable storage medium storing instructions executable by the one or more computer processors to cause the one or more computer processors to perform operations with the assembly. The computer processors receive the first signal from the first sensor. The condition of the arm includes a position of the arm relative to the body. The first signal includes a value of a first position of the arm relative to the body. The computer processors store the value of the first position in the non-transitory computer-readable storage medium. The computer processors receive a second signal from the first sensor. The condition of the arm includes a position of the arm relative to the body. The second signal includes a value of a second position of the arm relative to the body. The computer processors store the value of the second position in the non-transitory computer-readable storage medium.

The computer processors receive a first signal from the second sensor. The first signal includes a first inductance value at a first location in the well system. The computer processors store the first inductance value in the non-transitory computer-readable storage medium. The computer processors receive a second signal from the second sensor. The second signal includes a second inductance value at a second location in the well system. The computer processors store the second inductance value in the non-transitory computer-readable storage medium. The instructions include stored values for a dimension of the well system and an inductivity of the well system.

The computer processors compare the value of the first position of the arm, the value of the second position of the arm, the first inductance value, the second inductance value and the stored values for the dimension of the well system and the inductivity of the well system. Responsive to the comparison, the computer processors generate a command signal to operate the actuator sub-assembly to actuate the arm relative to the body or determine the location of the assembly in the well system.

The assembly includes a tool connector coupled to the body. The tool connector couples the assembly to a tool string.

In some implementations, the assembly further includes an arm kit. The arm kit includes multiple of arms including the arm. The multiple arms in the arm kit have different lengths.

In some implementations, the assembly further includes a wireless communications sub-assembly coupled to the control sub-assembly. The wireless communications sub-assembly receives a command signal from an operating station. The command signal represents a tool activate command or a tool deactivate command. The wireless communications sub-assembly transmits a status signal to the operating station. The status signal represents a condition of the assembly.

Further implementations of the present disclosure include a method for moving an arm and a body into a lateral branch wellbore from main wellbore through a lateral window. The method includes carrying into a well system by a downhole conveyor, the body coupled to the arm. The arm positions the body to enter the lateral window. The body and the arm are coupled to an actuator sub-assembly to actuate the arm relative to the body. The well system includes the main wellbore and the lateral branch wellbore. In some implementations, the main wellbore includes a casing. In some implementations, the lateral branch wellbore includes an open hole.

The method includes actuating, by the actuator sub-assembly, the arm to contact an inner surface of the main wellbore. In some implementations, where the actuator sub-assembly includes a pivot joint coupling the arm to the body, the pivot joint allows the arm to pivot relative to the body about the pivot joint. In some implementations, where the actuator sub-assembly includes a connector rod coupled to the arm and the body, the connector rod shifts the arm relative to the body about the pivot joint. In some implementations, where the actuator sub-assembly includes a magnetic coupling operatively coupled to the connector rod and where a linkage rod coupled to the connector rod and the magnetic coupling, the linkage rod actuates the connector rod responsive to a movement of the magnetic coupling. In such implementations, the method further includes energizing the magnetic coupling by the controller. In such implementations, the method further includes, responsive to energizing the magnetic coupling, sliding the magnetic coupling within the actuator sub-assembly. In such implementations, the method further includes, responsive to sliding the magnetic coupling within the actuator sub-assembly, sliding the linkage rod. In such implementations, the method further includes, responsive to sliding the linkage rod, actuating the connector rod. In such implementations, the method further includes, responsive to actuating the connector rod, shifting the arm relative to the body about the body to contact the arm to the inner surface of the well system.

The method includes moving, by the body, the arm along the inner surface of the main wellbore toward the lateral window until the arm contacts the lateral window. In some implementations, the assembly further includes a swivel coupled to the actuator sub-assembly and the body. The swivel rotates the actuator sub-assembly and the arm about the body. In such implementations, the method further includes, while simultaneously moving the arm along the inner surface of the main wellbore toward the lateral window, rotating, by the swivel, the arm to contact the lateral window.

The method includes receiving, by a controller connected to the body, the arm, and the actuator, a first signal representing a position of the arm relative to the body and a second signal representing when the assembly is located in the main wellbore or the lateral branch wellbore. The method includes comparing, by the controller, a value of the first signal at a first location in the well system and a value of the second signal at the first location in the well system to a value of the first signal at a second location in the well system and a value of the second signal at the second location in the well system and a characteristic n of the well system.

The method includes, responsive to the comparison, actuating, by the actuator sub-assembly, the arm to position the body to enter the lateral window. In some implementations, before moving the body into the lateral window, the method includes sensing a first condition of the well system. In some implementations, the method includes transmitting a first signal representing the first condition of the well system to the controller. In some implementations, the method includes, after moving the body into the lateral window, sensing a second condition of the well system. In some implementations, the method includes transmitting a second signal representing the second condition of the well system to the controller. In some implementations, the method includes comparing, by the controller, the first signal to the second signal. In some implementations, the method includes, responsive to the comparison, determining when the body enters the lateral window.

In some implementations, where the second signal represents when the assembly is located in the main wellbore or the lateral branch wellbore, the method includes sensing, by an inductive sensor, the well system inductance. In some implementations, where the first well system condition and the second well system condition includes a first well system inductance and a second well system inductance, respectively, the method further includes where sensing the first well system inductance indicates the body is in a casing of the well system and where sensing the second well system inductance indicates the arm and the body has passed through the lateral window and into an open hole of the lateral branch wellbore of the well system.

The method includes moving the arm and the body into the lateral window. In some implementations, where the body is carried into the well system by a downhole conveyor, the method further includes carrying, where the downhole conveyor includes an acid stimulation coiled tubing assembly, the downhole conveyor into the lateral branch wellbore through the lateral window. In some implementations, the method further includes flowing a fluid including an acid, by the acid stimulation coiled tubing assembly, into the lateral branch wellbore.

Further implementations of the present disclosure include a method implemented in a well system. The well system includes a main wellbore. In some implementations, the main wellbore includes a casing. The well system includes a lateral branch wellbore. In some implementations, the lateral branch wellbore includes an open hole. The lateral branch wellbore is connected to the main wellbore by a lateral window. The method includes carrying, by a controller, into the well system, a body coupled to an arm to position the body to enter the lateral branch wellbore through the lateral window. The body and the arm are coupled to an actuator sub-assembly to actuate the arm relative to the body.

The method includes actuating, by the controller, the arm relative to the body to a first position. When the arm is in the first position the arm is in contact with an inner surface of the well system.

The method includes moving, by the controller, the arm along the inner surface of the well system toward the lateral window. The method includes receiving, by the controller, from a first sensor coupled to the controller, where the first sensor senses the position of the arm relative to the body, the arm moving from the first position to a second position. Moving the arm from the first position to the second position indicates the arm has entered the lateral branch wellbore through the lateral window and the arm is in contact with an inner surface of the lateral branch wellbore. The signal represents that the arm has entered the lateral branch wellbore through the lateral window and the arm is contacting an inner surface of the lateral branch wellbore.

The method includes, responsive to receiving the signal representing that the arm has entered the lateral branch wellbore through the lateral window and the arm is contacting an inner surface of the lateral branch wellbore, actuating, by the controller, the arm to maintain contact with the inner surface of the lateral wellbore branch.

The method includes, receiving, by the controller, from the first sensor, a signal representing the arm has actuated to a third position. The third position indicates the arm is fully bent relative to the body in the lateral wellbore branch. In some implementations, after receiving the signal representing the arm has moved to a third position when the arm was moved to the third position by contacting the edge of the lateral window, the method further includes holding the arm locked at the third position by the actuation sub-assembly.

The method includes actuating, by the controller, the arm to a fourth position relative to the body. The fourth position is a partially bent position to not contact the inner surface of the lateral wellbore branch with the arm while maintaining the arm in the lateral window.

The method includes moving, by the controller, the arm in the lateral window. The method includes receiving, by the controller, the signal representing the arm has moved to a third position when the arm was moved to the third position by contacting an edge of the lateral window.

The method includes moving, by the controller, the arm and the body into the lateral branch wellbore through the lateral window by contacting the arm, while in the third position, to the edge of the lateral window to force the body through the lateral window and into the lateral branch wellbore. In some implementations, after moving the arm and the body into the lateral branch wellbore through the lateral window, the method further includes receiving, by the controller, from the first sensor, a signal representing that the arm has moved from the third position to the fourth position. The arm moving from the third position to the fourth position indicates the arm has contacted the inner surface of the lateral wellbore branch.

The method includes, responsive to receiving the signal representing that the arm has moved from the third position to the fourth position, actuating the arm to a fifth position relative to the body. The fifth position is a straight position to align the arm with the body.

In some implementations, the method further includes receiving, by the controller, from an inductive sensor coupled to the controller, where the inductive sensor senses an inductance in the well system and transmits a signal representing the inductance to the controller, a first signal representing a first value of a first inductance at a first location in the well system. In some implementations, the method further includes receiving, by the controller, a second signal representing a second value of a second inductance at a second location in the well system. In some implementations, the method further includes comparing, by the controller, the first value to the second value. In some implementations, the method further includes determining, by the comparison of the first value to the second value, when the arm and the body are in the casing of the main wellbore or in the open hole of the lateral branch wellbore. When the second value is the same as the first value, the arm and the body are in the casing of the main wellbore. When the second value is greater than the first value, the arm and the body are in the open hole of the lateral branch wellbore.

In some implementations, where an acid stimulator tool is coupled to the body, the method further includes flowing, by the controller a fluid including an acid from the acid stimulator tool into the lateral branch wellbore.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

FIG. 3 is a flow chart of an example method of entering a lateral branch wellbore from the main wellbore with the assembly of FIG. 1A according to the implementations of the present disclosure.

DETAILED DESCRIPTION

Figure 1A:
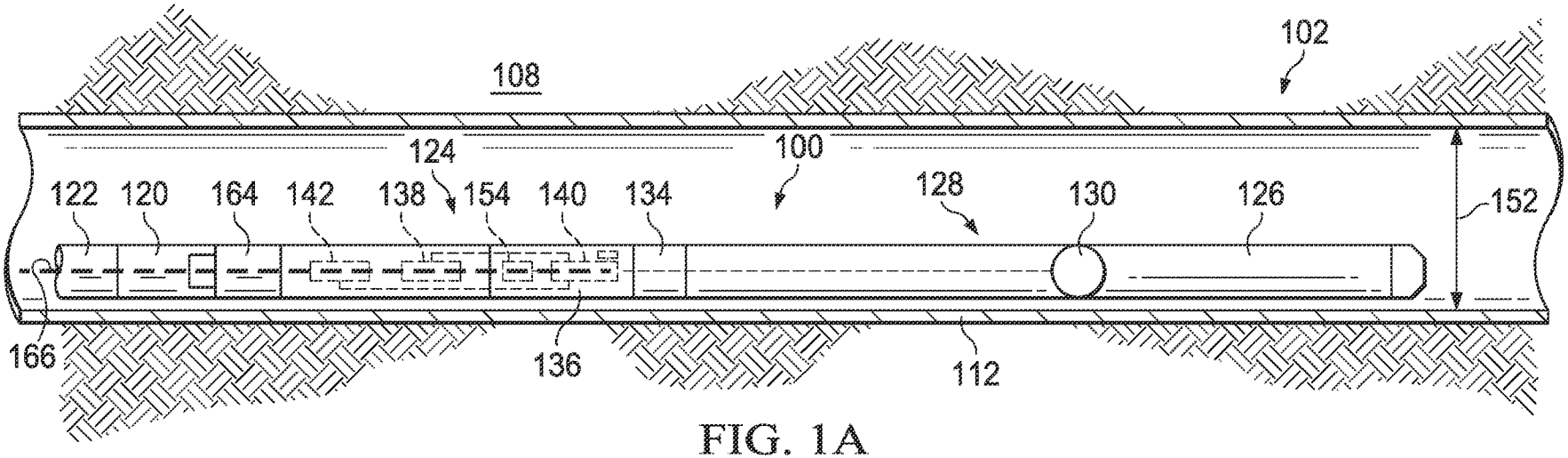
FIG. 1A is a schematic view of a lateral window locating and entering assembly moving in the wellbore in a downhole direction.

The present disclosure describes an assembly and a method for entering a lateral branch wellbore from a main wellbore with a lateral window locating and entering assembly. The assembly is disposed in a well system. The well system includes a main wellbore with a casing. A lateral branch wellbore including an open hole is coupled to the main wellbore by an opening. The opening is a lateral window. The lateral window can also be referred to as a casing window.

The assembly includes a body. An arm is coupled to the body. The arm positions the body to enter the lateral branch wellbore from the main wellbore through the lateral window. A tool connector is coupled to the body. The tool connector couples the assembly to a downhole conveyor. An actuator sub-assembly is coupled to the arm and the body. The actuator sub-assembly actuates the arm relative to the body.

The assembly includes a control sub-assembly coupled to the body. The control sub-assembly is operatively coupled to the actuator sub-assembly. The control sub-assembly includes a first sensor to sense a condition of the arm and transmit a first signal representing the condition of the arm. The control sub-assembly includes a second sensor to sense when the assembly is located in the casing or the open hole and transmit a second signal representing when the assembly is located in the casing or the open hole.

The control sub-assembly includes a controller. The controller receives the first signal, receives the second signal, and responsive to either the first signal or the second signal, the controller actuates the arm relative to the body to position the body to enter the opening.

Implementations of the present disclosure realize one or more of the following advantages. An acid stimulation tool string can reliably enter a lateral wellbore branch. For example, the assembly can successfully detect and enter the lateral wellbore branch with the acid stimulation tool string conveyed on a coiled tubing tool string. Additionally, the assembly can successfully autonomously detect and enter the lateral wellbore branch. In conventional multi-lateral wellbore logging operations, real-time operator control from the surface of the Earth is used to sense and steer the tool string into the lateral wellbore branch through the lateral window of the main wellbore. Accessing and entering into lateral branch wellbores for an acid stimulation operation can be achieved by the assembly without the control cable from the surface because the acid environment can corrodes control cable. Additionally, use of high pump rates for use for an acid stimulation operation can be achieved because a control cable is no longer needed to sense and enter a lateral branch wellbore. The use of a control cable through the coiled tubing tool string limits pump rates. Ease of maintenance and acid stimulation operations are simplified as complex visual or ultrasonic imaging systems to find and enter the lateral branch wellbore are not used. Complex visual or ultrasonic imaging systems require real time control from the surface by an operator. The assembly can autonomously perform the same functions as a conventional lateral entry assembly with the control cable and real-time high bandwidth data communication between the surface and downhole portion of the system, without the added complexity and limitations of using a control cable to successfully and reliably detect and enter the lateral wellbore branch. The assembly achieves this by autonomously sensing the lateral window and autonomously decision making to enter the lateral wellbore branch through the lateral window, without real time control from an operator on the surface.

Figure 1B:
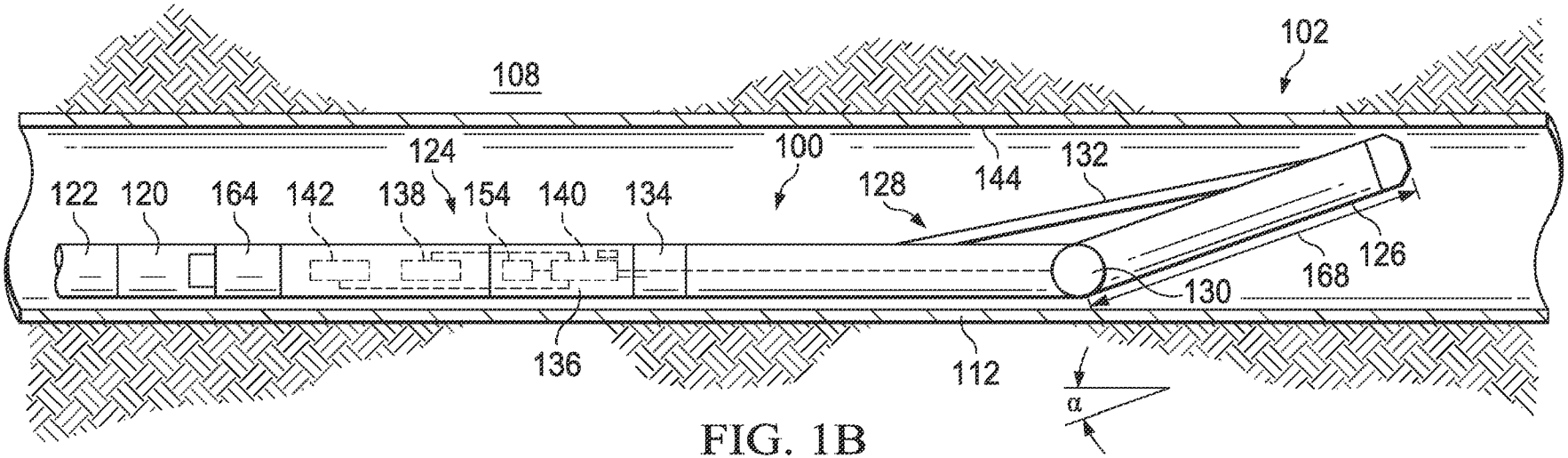
FIG. 1B is a schematic view of the assembly of FIG. 1A moving in the wellbore in a downhole direction with the arm actuated to contact an inner surface of the wellbore.
Figure 1C:
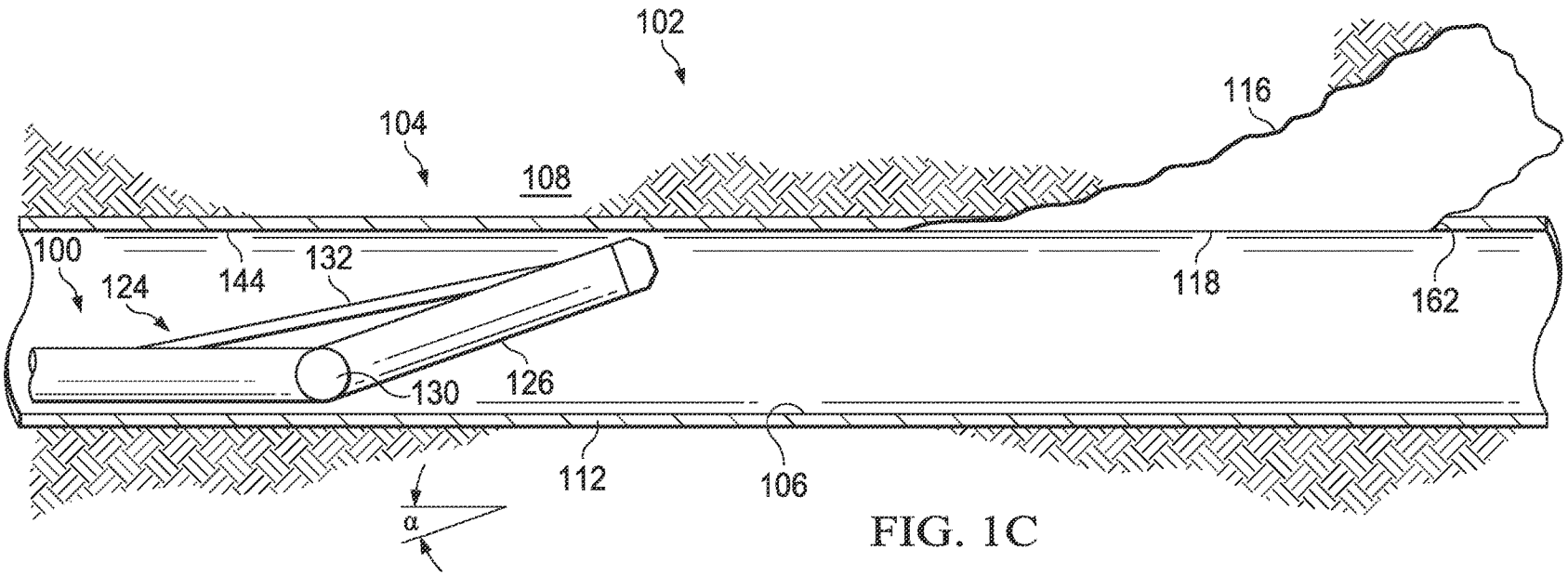
FIG. 1C is a schematic view of the assembly of FIG. 1A approaching a lateral window in the wellbore with the arm actuated to contact the inner surface of the wellbore.

FIG. 1A is a schematic view of a lateral window locating and entering assembly. FIG. 1B is a schematic side view of the lateral window locating and entering assembly of FIG. 1A with the arm bent relative to the body. Referring to FIGS. 1A-1B, the lateral window locating and entering assembly 100 is disposed in a well system 102. FIG. 1C is a schematic view of the lateral window locating and entering assembly approaching a lateral window in the wellbore with the arm actuated to contact the inner surface of the wellbore. Referring to FIG. 1C, the well system 102 includes a main wellbore 104. The main wellbore 104 is defined by an inner surface 106 which separates the main wellbore 104 from the formations 108 of the Earth. The main wellbore 104 extends into the formations 108 of the Earth from a surface (not shown) of the Earth. The formations 108 of the Earth contain pressurized liquid and gaseous phases of various fluids and chemicals including water, oils, and hydrocarbon gases. The main wellbore 104 includes a casing 112 to seal the main wellbore 104 from the formations 108 of the Earth and to control the flow of oil and gas from other portions of the main wellbore 104 to the surface of the Earth, such as a lateral branch wellbore 116.

As shown in FIG. 1C, the lateral branch wellbore 116 is an open hole. The lateral branch wellbore 116 is open to allow pressurized liquid and gaseous phases of various fluids and chemicals including water, oils, and hydrocarbon gases from the formations 108 to flow into the casing 112 and up to the surface of the Earth. An opening, for example, a lateral window 118 couples the lateral branch wellbore 116 to main wellbore 104. The lateral window 118 has an edge 162 which defines the perimeter of the lateral window 118 connecting the main wellbore 104 from the lateral branch wellbore 116.

The lateral window locating and entering assembly 100 is disposed in the well system 102 to locate the lateral window 118 and enter the lateral branch wellbore 116 through the lateral window 118. Referring to FIGS. 1A-1C, the lateral window locating and entering assembly 100 is coupled to a downhole conveyor 120. The downhole conveyor 120 can be a coiled tubing tool string. The downhole conveyor 120 conducts the lateral window locating and entering assembly 100 into the well system 102 from the surface. The downhole conveyor 120 includes an acid stimulator tool 122. The acid stimulator tool 122 flows a fluid containing an acid into the well system 102 to conduct an acid stimulation operation in the open hole of the lateral branch wellbore 116. An acid stimulation operation is conducted to increase the flow of water, oils, and hydrocarbon gases from the formations 108 into the lateral branch wellbore 116.

The assembly 100 includes a body 124. The body 124 is disposed in the well system 102. The body 124 is a hollow, generally cylindrical metal tube. The body 124 is a pressure vessel. The body 124 protects internal components (described later) from well system 102 harmful environments such as a high temperature, a high pressure, and corrosive chemicals. A tool connector 164 is coupled to the body 124 to connect the body 124 to the downhole conveyor 120.

The assembly 100 includes an arm 126 coupled to the body 124. The arm 126 positions the body 124 to enter the lateral branch wellbore 116 from the main wellbore 104 through the lateral window 118. An actuator sub-assembly 128 is coupled to the arm 126 and the body 124. The actuator sub-assembly 128 actuates the arm 126 relative to the body 124 to position the arm 126 to locate and enter the lateral window 118.

Figure 2A:
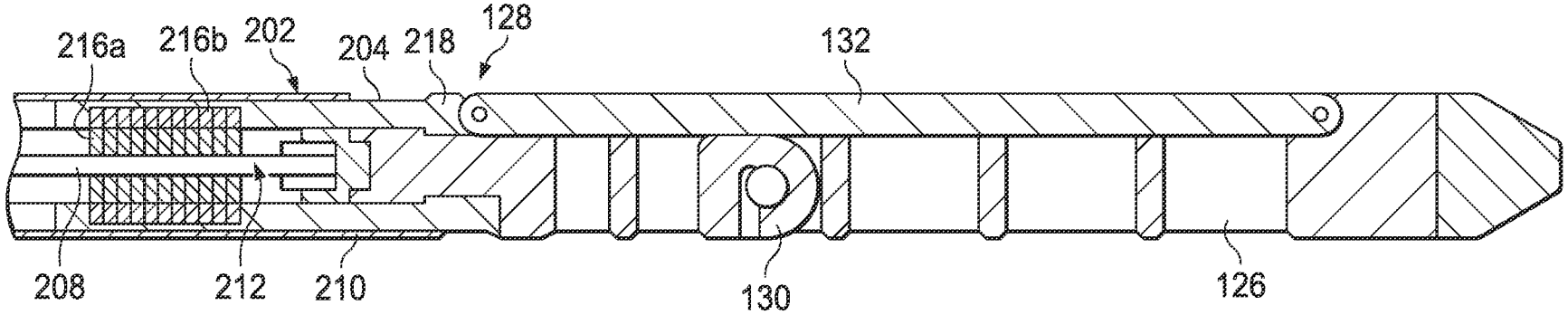
FIG. 2A is a cross-sectional side schematic view of the assembly of FIG. 1A.
Figure 2B:
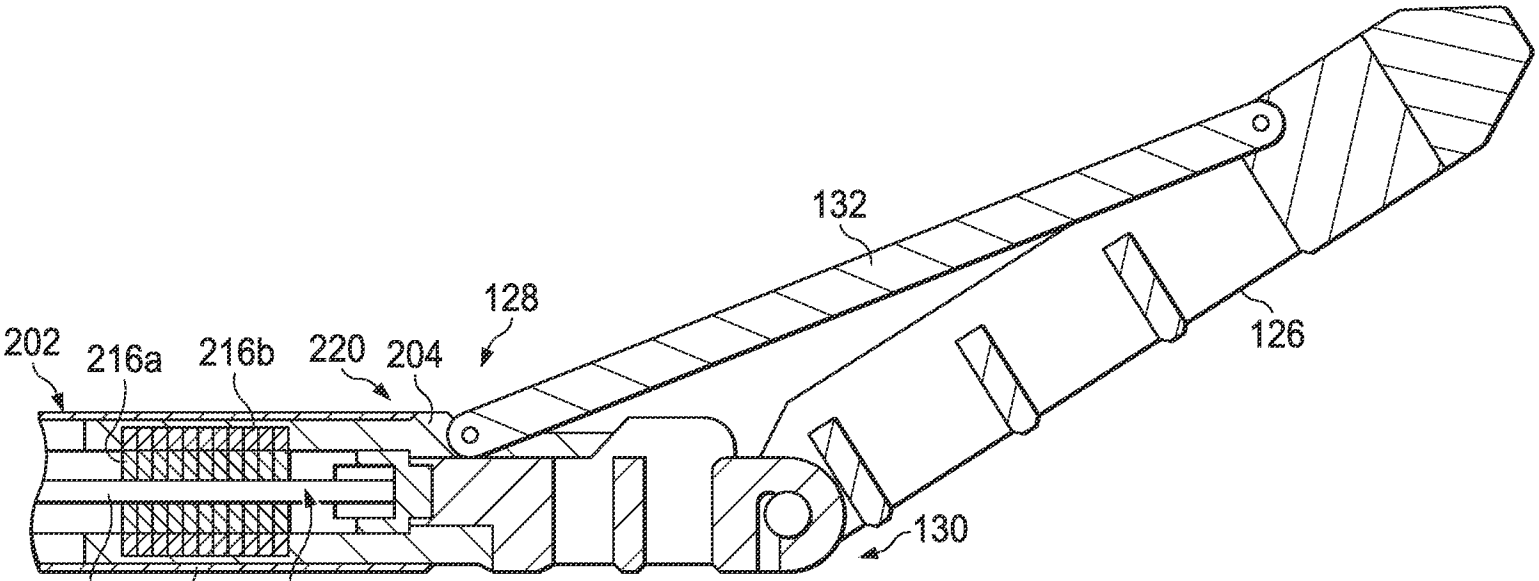
FIG. 2B is a cross-sectional side schematic view of the assembly of FIG. 1B.

FIG. 2A is a cross-sectional side schematic view of the lateral window locating and entering assembly of FIG. 1A. FIG. 2B is a cross-sectional side schematic view of the lateral window locating and entering assembly of FIG. 1A with the arm bent relative to the body. Referring to FIGS. 1A-1C and FIGS. 2A-2B, the actuator sub-assembly 128 includes a pivot joint 130 coupling the arm 126 to the body 124. The pivot joint 130 allows the arm 126 to pivot relative to the body 124 about the pivot joint 130.

The actuator sub-assembly 128 includes a connector rod 132. The connector rod 132 is coupled to the arm 126 and the body 124. The connector rod 132 shifts the arm 126 relative to the body 124 about the pivot joint 130.

Referring to FIGS. 2A and 2B, the actuator sub-assembly 128 includes a magnetic coupling 202 operatively coupled to the connector rod 132 by a linkage rod 204. The linkage rod 204 is coupled to the connector rod 132 and the magnetic coupling 202. The linkage rod 204 actuates the connector rod 132 responsive to a movement of the magnetic coupling 202 within a body 210 of the actuator sub-assembly 128. The magnetic coupling 202 is operated by a linear actuator rod 208 coupled to a driver (not shown). The driver can be a motor or a hydraulic sub-assembly contained within the body 210 of the actuator sub-assembly 128. The body 210 is generally similar to the body 124 described previously in reference to FIG. 1A. The body 210 is a hermetically sealed chamber used to house the electronic and drive components of the lateral window locating and entering assembly 100 described here, protecting the electronic and drive components from the harsh downhole environment (high temperature, high pressure, and corrosive chemicals).

The driver moves the linear actuator rod 208 from a first position 212, shown in FIG. 2A, to a second position 214, shown in FIG. 2B. Moving the linear actuator rod 208 from the first position 212 to the second position 214 moves a first magnetic component 216*a* of the magnetic coupling 202 inside the body 210. A second magnetic component 216*b*, outside the body 210 and magnetically coupled to the first magnetic component 216*a*, moves, along with the linkage rod 204. The linkage rod 204 moves from a first position 218, shown in FIG. 2A, to a second position 220, shown in FIG. 2B. When the linkage rod 204 is in the first position 218, the connector rod 132 is aligned with both the body 124 and the arm 126 in a straight line (FIGS. 1A and 2A). When the linkage rod 204 is in the second position 220, the connector rod 132 is at an angle α with the arm 126 bent relative to the body 124 (FIGS. 1B and 2B) about the pivot joint 130. The pivot joint 130 allows the arm 126 to rotate with two dimensions, or in other words, cylindrical coordinates. Rotation of the arm 126 around a longitudinal axis 166 of the assembly 100 and bending of the arm 126 by the actuator sub-assembly 128 relative to the longitudinal axis 166 of the body 124 defines a radius 168 of the arm 126 extending from the longitudinal axis 166 of the assembly 100.

The actuator sub-assembly 128 includes a swivel 134 coupled to the actuator sub-assembly 128 and the body 124. The swivel 134 rotates the actuator sub-assembly 128 and the arm 126 about the body 124. The swivel 134 rotates the actuator sub-assembly 128 and the arm 126 in 360 degrees about the longitudinal axis 166 of the body 124. The swivel 134 includes a rotational actuator (not shown) driven by a motor (not shown) to position the arm 126 radially relative to the body 124. The motor can be an electrical motor or a hydraulic motor. The transfer of torque from the motor to the actuator sub-assembly 128 can be achieved by the use of a second magnetic coupling (not shown), substantially similar to the magnetic coupling 202 previously described for bending of the arm 126. The second magnetic coupling body 210 is also positioned within the body 210. The body 210 is a hermetically sealed chamber used to house the electronic and drive components of the assembly 100 described here, protecting the electronic and drive components from the harsh downhole environment (high temperature, high pressure, and corrosive chemicals).

The assembly 100 includes a control sub-assembly 136 positioned with and coupled to the body 124. The control sub-assembly 136 controls the operation of the actuator sub-assembly 128.

The control sub-assembly 136 includes a first sensor 138 to sense a condition of the arm 126 and transmit a first signal representing the condition of the arm 126 to a controller 140 (described later). The condition of the arm 126 can be the position of the arm 126 relative to the body 124. For example the first sensor 138 can measure the rotation angle (not shown) about center axis of the body 124 to which the arm 126 is oriented. For example, the first sensor 138 can measure angle α, the angle of the arm 126 to the center axis of the body 124. For example, the first sensor 138 can measure a value of a force and a direction of the force applied to the arm 126.

Figure 1D:
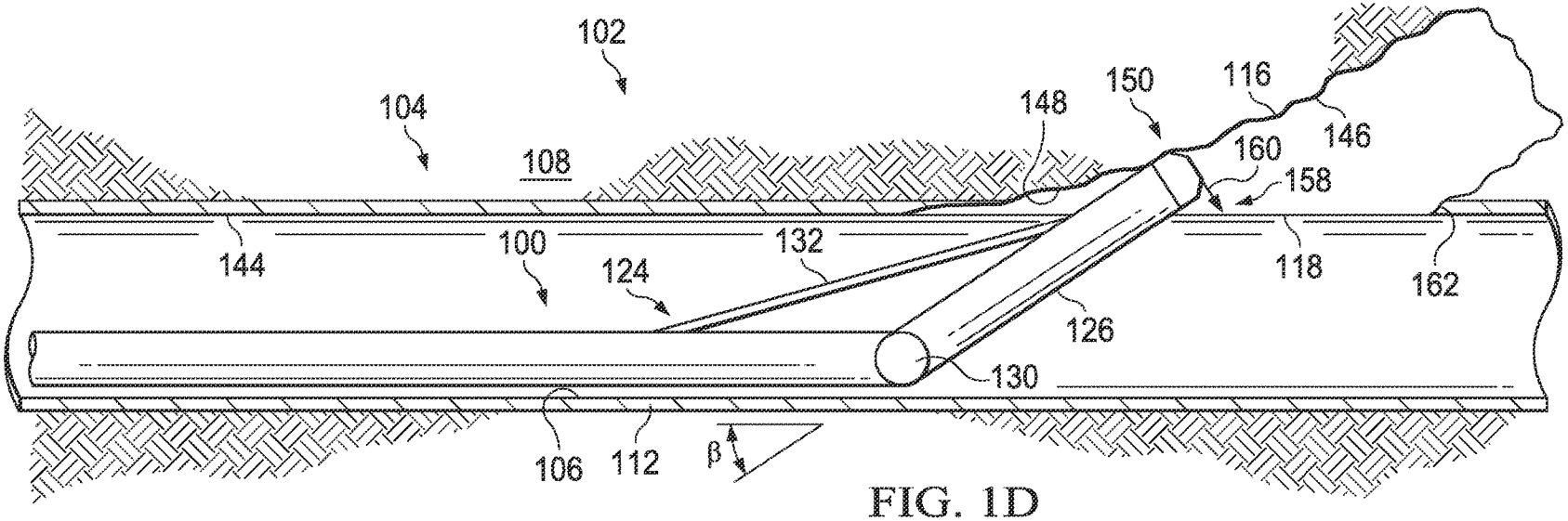
FIG. 1D is a schematic view of the arm of the assembly of FIG. 1A entering the lateral window with the arm actuated to contact the inner surface of a lateral branch wellbore.

The position of the arm 126 can be described relative to the body 124, and the various components of the well system 102. For example, as shown in FIG. 2A, when the arm 126 is in a first position, the arm 126 is straight relative to the body 124 to allow the assembly 100 to travel through the wellbore 116. For example, as shown in FIGS. 2B-2C, when the arm 126 is in a second position, the arm 126 is bent relative to the body 124 to contact an inner surface 144 of the casing 112. FIG. 1D is a schematic view of the arm of the lateral window locating and entering assembly entering the lateral window with the arm actuated to contact the inner surface of a lateral branch wellbore. For example, as shown in FIG. 1D, when the arm 126 is in a third position, the arm 126 has entered the lateral branch wellbore 116 through the lateral window 118 and the arm 126 is in contact with an inner surface 146 first location 148 of the lateral branch wellbore 116. When the arm 126 is in the third position, it is at an angle greater than the angle α, but less than a fully bent angle as described next. For example, as shown in FIG. 1D, when the arm 126 is in a fourth position, the arm 126 is fully bent relative to the body 124 in the lateral wellbore branch in contact with the inner surface 146 at a second location 150. The arm is fully bent relative to the body 124 at an angle β.

Additionally, for example, as shown in FIG. 1D, when the arm 126 is in a fifth position 158, shown by arrow 160, the arm 126 is partially bent and held, by the actuator sub-assembly 128 at an angle less than the angle β but greater than the angle α to not contact the inner surface 146 of the lateral branch wellbore 116 with the arm 126 while maintaining the arm 126 in the lateral window 118. FIG. 1F is a schematic view of the assembly of FIG. 1A entering the lateral branch wellbore through lateral window. Finally, as shown in FIG. 1G, when the arm 126 is in a sixth position, the arm 126 is straight and in line with the body 124 to align the arm 126 with the body 124 in the lateral branch wellbore 116 (similar to the first position as shown in FIG. 1A). The fifth position 128 is a partially bent position to be able to detect when the edge 162 of the lateral window 118 catches the arm 126 and forces it back to the fully bent position (FIG. 1D).

The control sub-assembly 136 includes a second sensor 142 to sense when the assembly 100 is located in the casing 112 or the open hole of the lateral branch wellbore 116 and transmit a second signal representing when the assembly 100 is located in the casing 112 or the open hole of the lateral branch wellbore 116 to the controller 140. The second sensor 142 is an inductive sensor. The second sensor 142 senses an inductance value. The second sensor 142 measure the inductance at a first time and a first location in the well system 102. The inductance at the first time and the first location is the first inductance value. The second sensor 142 then measures the inductance at a second time and a second location in the well system 102. The inductance at the second time and the second location is the second inductance value.

The control sub-assembly 136 includes an accelerometer (not shown). The accelerator senses an orientation, a position, and a motion of the assembly 100 within the well system 102. The accelerator generates a signal representing the orientation, the position, and the motion of the assembly 100 to the controller 140.

The controller 140 receives the first signal, receives the second signal, and responsive to either the first signal or the second signal, the controller 140 actuates the arm 126 relative to the body 124 to position the body 124 to enter the lateral window 118. The controller 140 receives and compares the first signal at different times and different locations within the well system 102 to locate the lateral window 118. The controller 140 receives and compares the second signal at different times and different locations within the well system 102 to locate the lateral window 118 and determine when the assembly 100 is located in the casing 112 or the open hole of the lateral branch wellbore 116.

The controller 140 includes one or more computer processors. The controller 140 includes a non-transitory computer-readable storage medium storing instructions executable by the one or more computer processors to cause the one or more computer processors to perform operations. The operations include receiving the first signal from the first sensor 138 at a first location and second time in the well system 102 and storing the value of the first position in the non-transitory computer-readable storage medium. The operations include receiving a second signal from the first sensor 138 at a second location and second time and storing the value of the second location and the second time in the non-transitory computer readable storage medium. The operations include receiving the first signal (the first inductance value) from the second sensor 142 and storing the first inductance value in the non-transitory computer-readable storage medium. The operations include receiving the second signal (the second inductance) from the second sensor and storing the second inductance value in the non-transitory computer-readable storage medium. The instructions include stored values for a dimension of the casing. For example, the dimension of the casing 112 can be an inner diameter 152 of the casing. The stored values can include and an expected inductance value of the casing 112 or the open hole. The operations include receiving the orientation, the position, and the motion of the assembly 100 from the accelerometer. The operations include comparing the first value of the first position of the arm 126, the value of the second position of the arm 126, the first inductance value, the second inductance value and the stored values for the dimension of the casing 112, the inductivity of the casing 112, the orientation, the position, and the motion of the assembly 100. The operations include responsive to the comparison, generating a command signal to operate the actuator sub-assembly 128 to actuate the arm 126 relative to the body 124.

Referring to FIGS. 1A-1B, the assembly 100 includes a power sub-assembly 154 to supply power to a control sub-assembly 136 and the actuator sub-assembly 128. The power sub-assembly 810 can includes a downhole turbine (not shown), a battery (not shown), or a power connection (not shown) to the downhole conveyor to supply power from the downhole conveyor.

The assembly 100 includes a wireless communications sub-assembly 156. The wireless communications sub-assembly 156 receives a command signal from a remote control station (not shown). The remote control station can be an operating station at the surface which transmits the command signal through the well system 102 and is received by the wireless communications sub-assembly 156. The command signal can direct the control sub-assembly 136 to activate the assembly or to deactivate the assembly 100. The wireless communications sub-assembly 156 transmit a status signal to the operating station. The status signal represents a condition of the assembly 100.

The assembly 100 can include an arm kit (not shown). The arm kit can include multiple arms including the arm 126. The arms have different lengths. The arms of different lengths accommodate positioning the assembly in well systems 102 with different inner diameters 152.

FIG. 3 is a flow chart of an example method of entering a lateral branch wellbore from the main wellbore with the lateral window locating and entering assembly according to the implementations of the present disclosure. At 302, a body is coupled to an arm to position the body to enter the lateral window. The body and the arm are coupled to an actuator sub-assembly to actuate the arm relative to the body. The body, the arm, and the actuator sub-assembly are carried into a well system by a downhole conveyor. The well system includes a main wellbore. The main wellbore includes a casing. The well system includes a lateral branch wellbore. The lateral branch wellbore is an open hole connected to the main wellbore by a lateral window.

At 304, the actuator sub-assembly actuates the arm to contact an inner surface of the main wellbore. In some implementations, the actuator sub-assembly includes a pivot joint coupling the arm to the body. The pivot joint allows the arm to pivot relative to the body about the pivot joint. A connector rod is coupled to the arm and the body. The connector rod shifts the arm relative to the body about the pivot joint. A magnetic coupling is operatively coupled to the connector rod. A linkage rod is coupled to the connector rod and the magnetic coupling. The linkage rod actuates the connector rod responsive to a movement of the magnetic coupling. When the actuator sub-assembly includes the pivot joint, the connector rod, the magnetic coupling, and the linkage rod, the method further includes energizing the magnetic coupling by the controller. Responsive to energizing the magnetic coupling, the magnetic coupling slides within the actuator sub-assembly. Responsive to sliding the magnetic coupling within the actuator sub-assembly, the linkage rod slides. Responsive to sliding the linkage rod; actuating the connector rod. Responsive to actuating the connector rod, the arm shifts relative to the body about the body to contact the arm to the inner surface of the well system.

In some implementations, a swivel is coupled to the actuator sub-assembly and the body. The swivel rotates the actuator sub-assembly and the arm about the body. When the swivel is coupled to the actuator sub-assembly, the method further includes, while simultaneously moving the arm along the inner surface of the main wellbore toward the lateral window, rotating, by the swivel, the arm to contact the lateral window.

At 306, the body moves the arm along the inner surface of the main wellbore toward the lateral window until the arm contacts the lateral window. The swivel 134 can rotate the arm 126 and maintain the angle of the arm 126 at an offset angle relative to a gravitational field vector generated by the gravitational field of Earth (in a downward direction relative to the surface of the Earth). For example, the arm 126 can be moved to the offset angle by either an activation commands sent from surface or a pre-programmed command sent from the controller 140 to the arm 126 to "ACTIVATE LEFT" or "ACTIVATE RIGHT". Left or right is defined as a relative side of the tool face (the orientation of the assembly 100) relative to the gravitational field vector. The offset angle can be 90° from the downward direction (gravitational field vector is set to 0°) when the "ACTIVATE LEFT" command is given. Similarly, the offset angle can in the other direction can be 270° from the downward direction (gravitational field vector is set to 0°) when "ACTIVATE RIGHT" command is given. The offset angle, for example, for the "ACTIVATE LEFT" command, can range from 10-170° relative to the gravitational field vector. Alternatively or in addition, the swivel 134 can rotate the arm 126 continuously while the assembly 100 moves through the wellbore 104 towards the lateral window 118. When the arm 126 is moved and rotated into the lateral window 118 (the opening of the wellbore 116), the sudden change (increase) in the arm 126 bending angle is sensed by the first sensor 138, and the continuous rotation of the swivel 134 is stopped. The swivel 134 rotation speed can typically range from 1 to 120 revolutions per minute (rpm).

At 308, a controller connected to the body, the arm, and the actuator receives a first signal representing a position of the arm relative to the body and a second signal representing when the assembly is located in the casing or the open hole. The second signal represents when the assembly is located in the casing or the open hole by sensing, with an inductive sensor, the well system inductance. The first well system condition is a first well system inductance and the second well system condition is a second well system inductance.

At 310, the controller compares a value of the first signal at a first location in the well system and a value of the second signal at the first location in the well system to a value of the first signal at a second location in the well system and a value of the second signal at the second location in the well system and a dimension of the casing.

At 312, the second sensor senses the first well system condition and transmits a first signal representing the first well system condition to the controller. Sensing the first well system inductance indicates the body is in a casing of the well system.

At 314 responsive to the comparison, the actuator sub-assembly actuates the arm to position the body to enter the lateral window.

At 316, the arm and the body move into the lateral window.

At 318, the second sensor senses the second well system condition and transmits a second signal representing the second well system condition to the controller. Sensing the second well system inductance indicates the arm and the body has passed through the lateral window and into an open hole lateral of the well system.

At 320, the controller compares the first signal to the second signal.

At 322, responsive to the comparison, the controller determines when the body enters the lateral window.

At 324, when the downhole conveyor includes an acid stimulation tool string and a coiled tubing, the method includes carrying the acid stimulation tool string into the lateral through the lateral window and flowing an fluid including an acid, by the acid stimulation tool string, into the open hole lateral wellbore.

Figure 4:
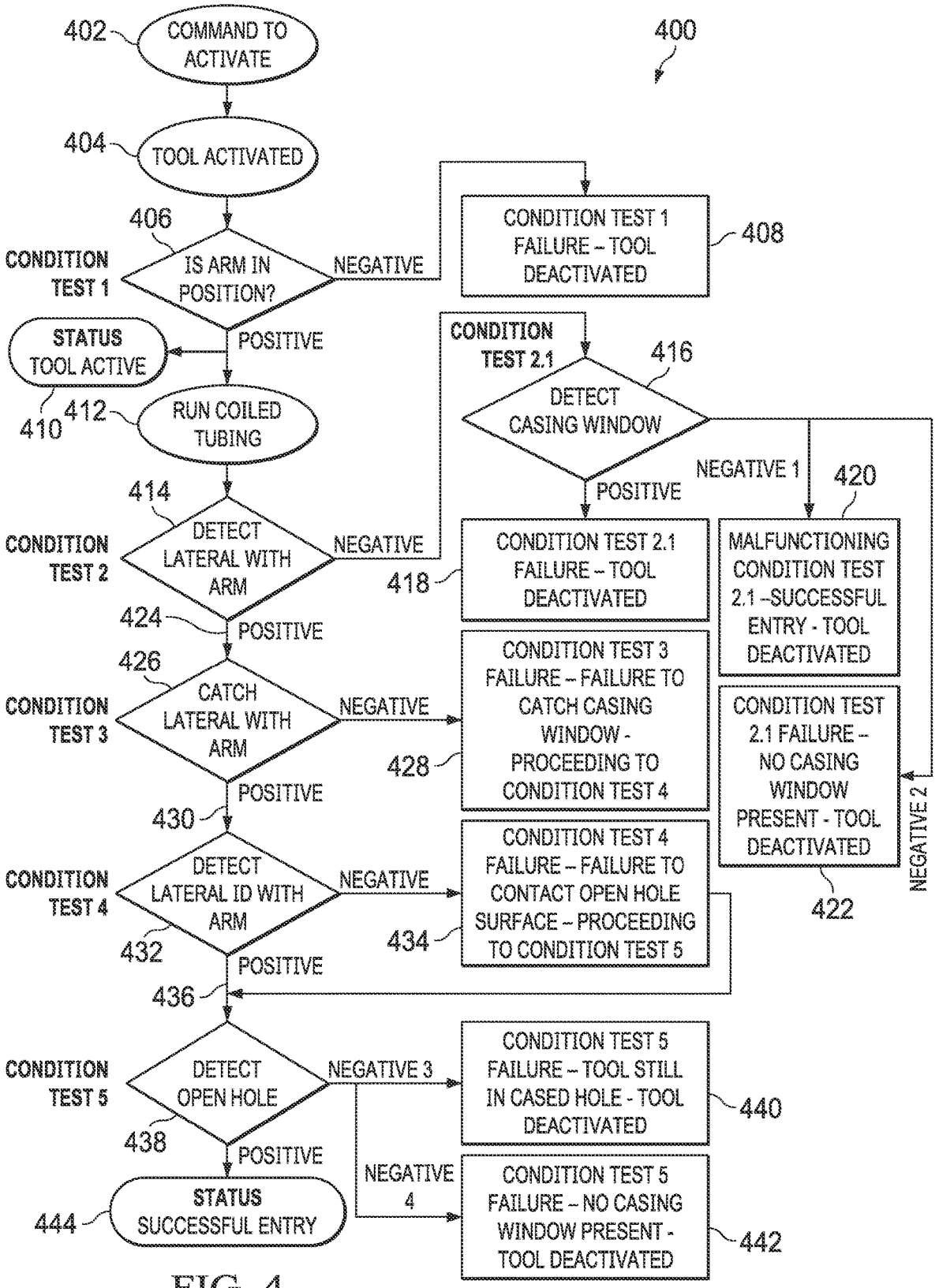
FIG. 4 is a flow chart of a control algorithm for entering a lateral branch wellbore from a main wellbore with the assembly of FIG. 1A.

FIG. 4 is a flow chart of a control algorithm 400 for entering a lateral branch wellbore from a main wellbore with the lateral window locating and entering assembly. The assembly 100 is positioned in the main wellbore 104 in an uphole direction from the lateral window 118 using the downhole conveyor 120.

At 402, a command "Activate Tool" is sent to the assembly 100 by the operator. For example, the "Activate Tool" command can direct, when the downhole conveyor 120 and the assembly 100 is "X" feet uphole from the lateral window, to activate the assembly 100 and wait until confirmation is received.

At 404, upon receiving the "Activate Tool" command, the assembly 100 powers on.

At 406, the assembly 100 performs Condition Test 1. Condition Test 1 is described below.

First, in Condition Test 1.1 of Condition Test 1, the actuator sub-assembly bends the arm towards the inner surface of the casing. The arm contacts the inner surface of the casing, which is measured when a predetermined force is detected on the arm, preventing the arm to fully extend. The measured angle on the arm will be given the notation a (partially bent), as shown in FIG. 1B.

Second, in Condition Test 1.2 of Condition Test 1, assembly 100, by the controller, compares the measured angle $\alpha$ to a predetermined value range which corresponds to the casing size and weight class inner diameter. If angle $\alpha$ is within the range, Condition Test 1.1 will be positive. If angle $\alpha$ outside the range, condition test 1.1 will be negative.

Third, in Condition Test 1.3 of Condition Test 1, the assembly 100 continuously rotates the arm about the body by the swivel joint at predetermined speed while the assembly moves downhole to detect an increase in the angle $\alpha$ (the angle of the arm bending relative to the body). When a selectable number of full revolutions is made, condition test 1.3 will be positive. When the arm in not able to complete the revolutions, condition test 1.3 will be negative.

At 408, when Condition Test 1 (either Condition Test 1.2 or 1.3 or both) is negative, the assembly 100 will straighten the arm and deactivate and send a status message to the operator confirming the tool has been deactivated with a corresponding "Condition Test 1 Failure—Tool Deactivated" message.

At 410, when Condition Test 1 is positive, a status message confirming "Tool Active" is sent to operator. When Condition Test 1 is positive, the arm stops rotating instantly. The assembly 100 is now ready to locate and enter the lateral branch wellbore through the lateral window.

At 412, When the status message "Tool Active" is received by the operator, the operator moves the assembly 100 by the downhole conveyor 120 at "Y" feet per minute for "Z" feet distance within the well system 102, as shown when the assembly moves from FIG. 1B to FIG. 1C.

At 414, the assembly 100 conducts Condition Test 2 to locate and enter the lateral window 118. As shown in FIG. 1C, the arm is pushed against the inner surface of the casing. When the arm enters the lateral branch wellbore through the lateral window, the arm is able to fully bend to a new angle $\beta$ (fully bent), as shown in FIG. 1D.

The assembly 100 compares the measured angle $\beta$ to a predetermined value range which is larger than the corresponding casing size and weight class inner diameter. When the angle $\beta$ is above this range, Condition Test 2 will be positive. When the angle β is under this range, and a predetermined timer runs out, Condition Test 2 will be negative.

When Condition Test 2 is negative, the assembly 100 proceeds to Condition Test 2.1.

Figure 5A:
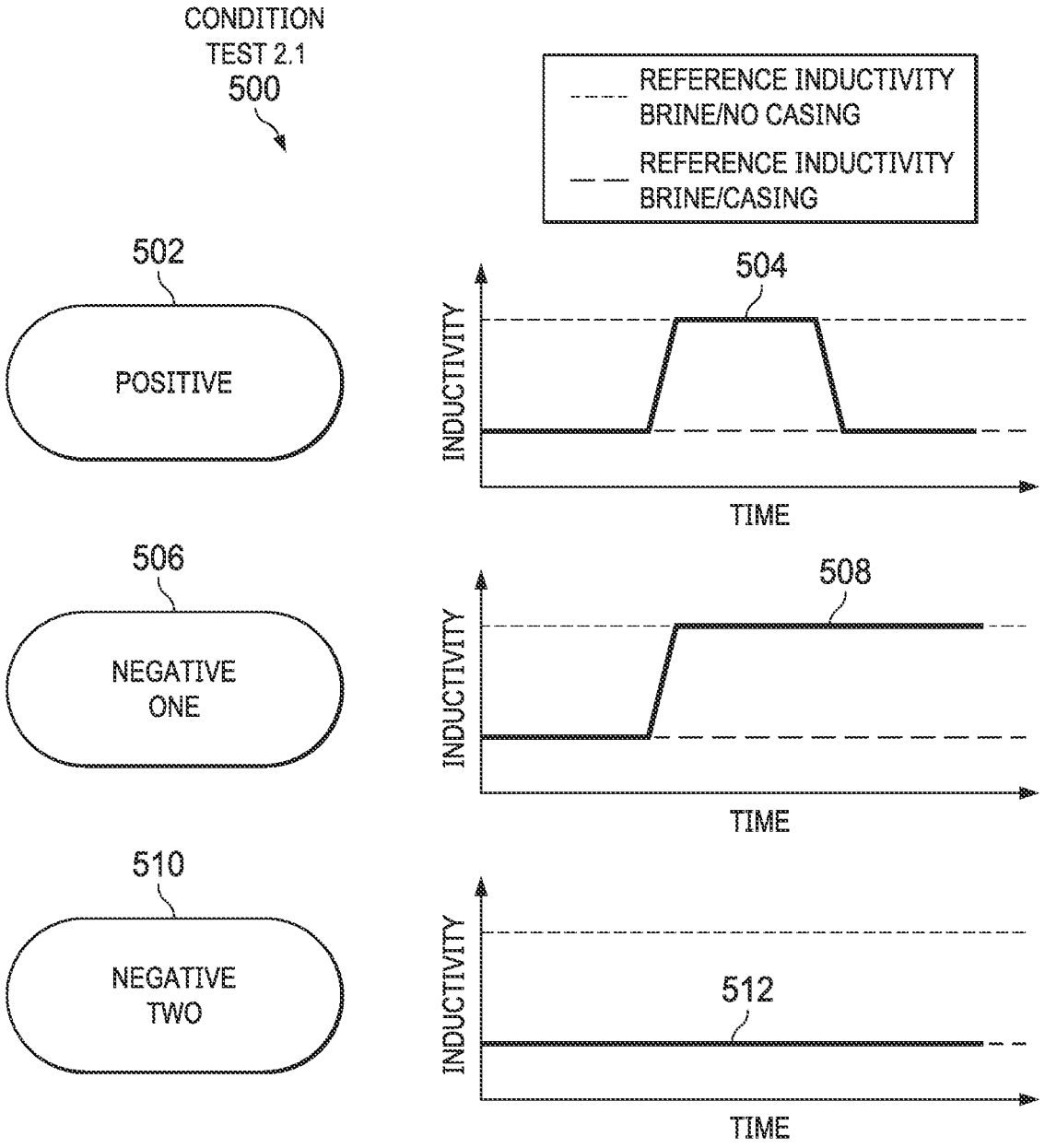
FIG. 5A is a graphical view of inductance with respect to time for the status messages of Condition Test 2.1 of FIG. 4.

At 416, the assembly 100 conducts Condition test 2.1. Condition Test 2.1 uses the second sensor (the inductance sensor) to sense when the lateral window will pass by the assembly 100 as the assembly 100 is run farther in the downhole direction into the well system 102. This is achieved by comparing the inductivity measurements over a predetermined time interval. FIG. 5A is a graphical view 500 of inductance with respect to time for the status messages of Condition Test 2.1 of FIG. 4.

At 418, referring to FIGS. 4 and 5A, when the inductivity with respect to time, as measured between the first location and the second location, increases above a predetermined threshold for a predetermined duration, and then returns to the same level of inductivity 504, Condition Test 2.1 will be positive 502 (Error Message 4) as the assembly 100 has detected a passing of the lateral window and that the assembly is still in the cased hole because a metallic environment is surrounding the assembly 100. When Condition Test 2.1 is positive 502, the assembly 100 will straighten the arm and deactivate and send a status message to the operator confirming the tool has been deactivated with a corresponding "Condition Test 2.1 Failure—Tool Deactivated" message.

At 420, referring to FIGS. 4 and 5A, when the inductivity increases above a predetermined threshold for a predetermined second duration 508, Condition Test 2.1 will be a Negative 1 506 as the assembly 100 has detected a successful entry into an open hole environment, with a malfunctioning Condition Test 2. The assembly 100 will straighten the arm and deactivate and send a status message to the operator confirming the tool has been deactivated with a corresponding "Malfunctioning Condition Test 2.1—Successful Entry—Tool Deactivated" message.

At 422, referring to FIGS. 4 and 5A, when the inductivity does not increase above a predetermined threshold for a predetermined duration of time 512, Condition Test 2.1 will be a Negative 2 510 as the assembly 100 has detected no lateral window passing in the casing. The assembly 100 will straighten the arm and deactivate and send a status message to the operator confirming the tool has been deactivated with a corresponding "Condition Test 2.1 Failure—No Lateral Window Present—Tool Deactivated" message.

At 424, when Condition Test 2 is positive, the assembly 100 repositions the arm to a slightly shallower angle (<β) and hold this position, as shown in FIG. 1D with the arm at position 158. When Condition Test 2 is positive, the assembly 100 proceeds to Condition Test 3 and the next condition test (Condition test 3) is started.

Figure 1E:
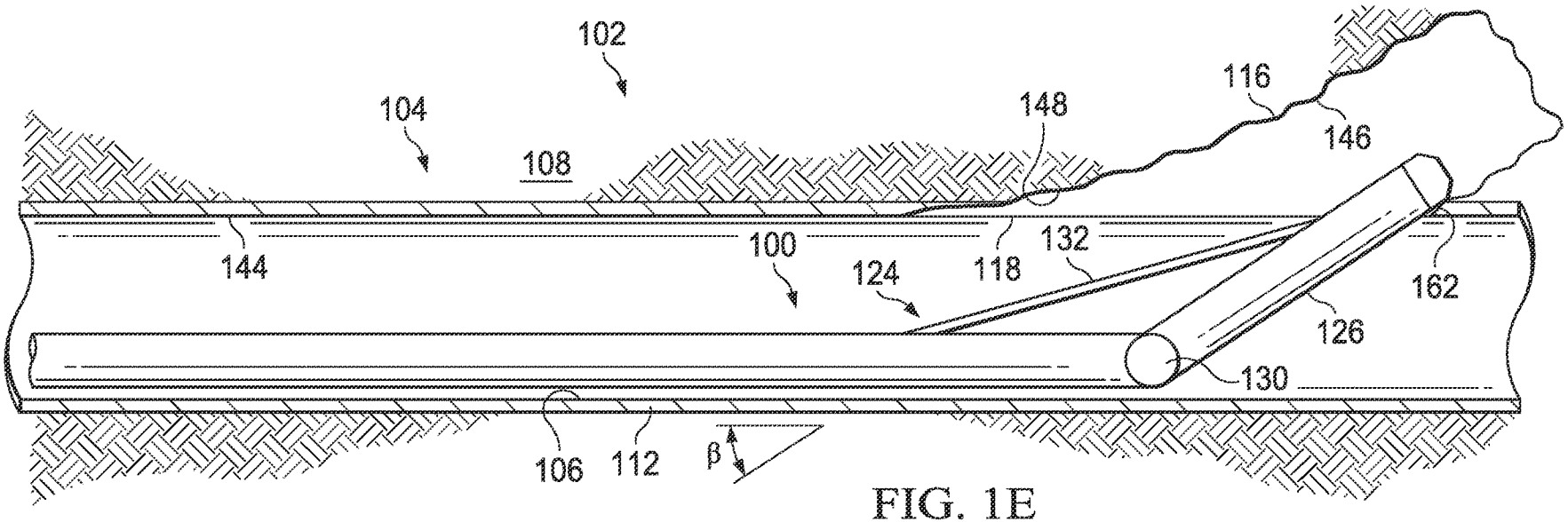
FIG. 1E is a schematic view of the arm of the assembly of FIG. 1A contacting an edge of the lateral window.
Figure 1F:
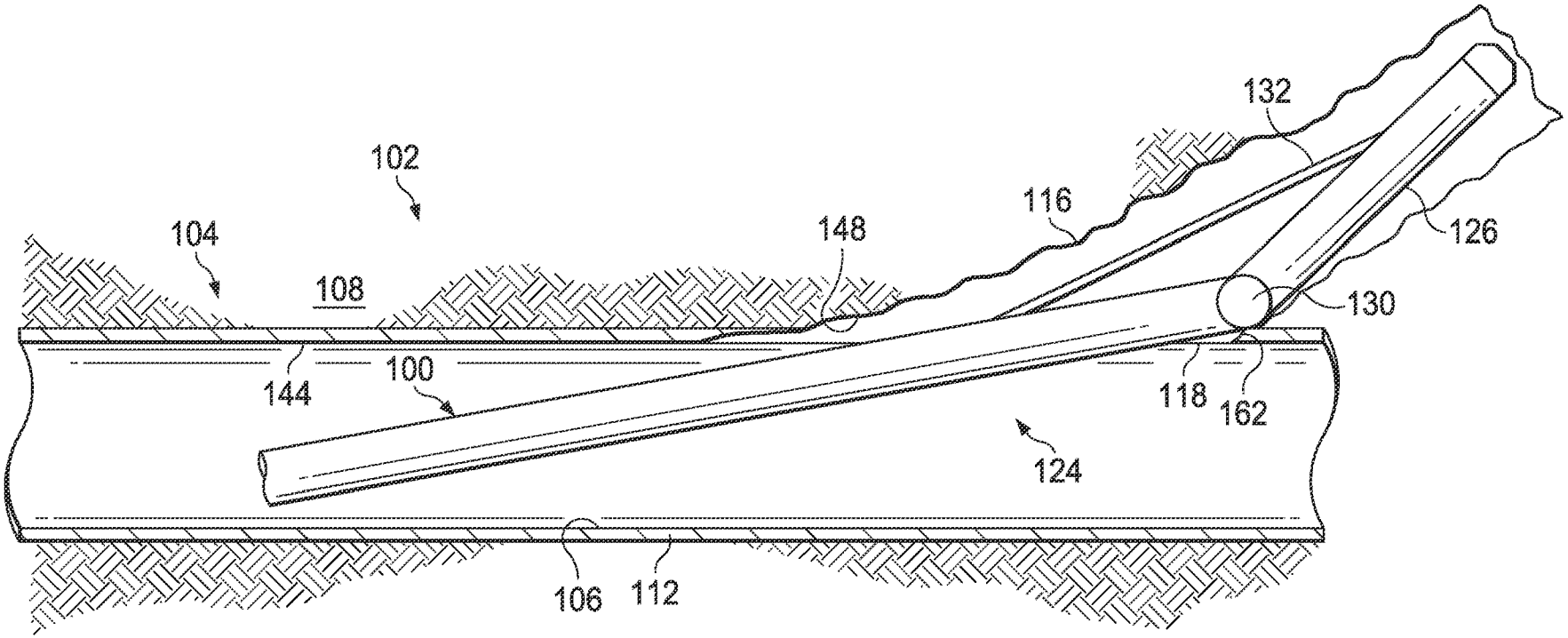
FIG. 1F is a schematic view of the assembly of FIG. 1A entering the lateral branch wellbore through lateral window.
Figure 1G:
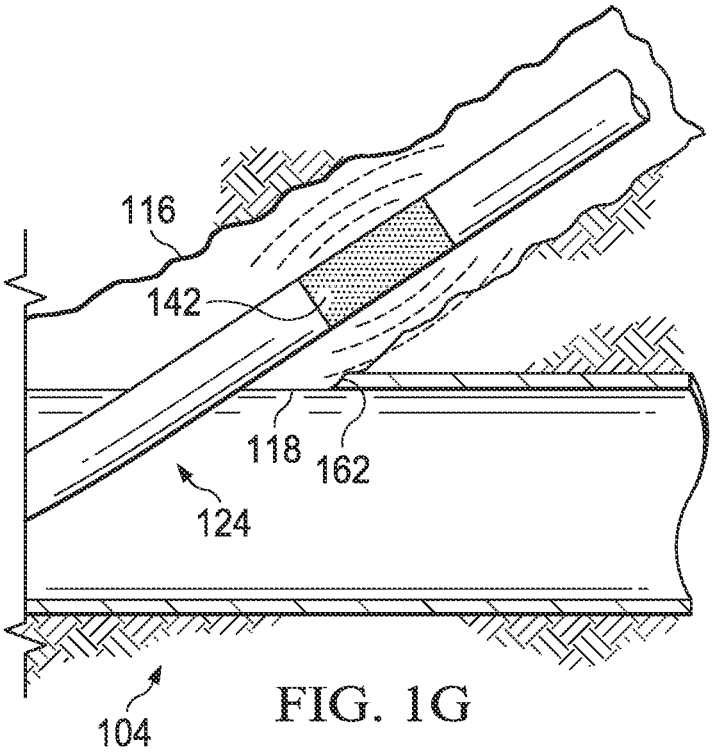
FIG. 1G is a schematic view of the assembly of FIG. 1A measuring inductance of the lateral branch wellbore.

At 426, the assembly 100 conducts Condition Test 3, as shown when the assembly 100 moves the arm from the position 158 in FIG. 1D to the edge 162 of the lateral window 118 as shown in FIG. 1E. As described earlier in reference to step 424, the arm is positioned and monitored at the shallow angle (<β) while the assembly 100 is run deeper in the well system 102 until the arm catches the edge 162 of the lateral window 118. When the arm catches the edge 162 of the lateral window 118, the arm will be pushed back at the fully bent angle β position.

At 428, when the monitored shallow angle (β) does not increases to the fully bent angle β position within a predetermined time duration, Condition Test 3 is negative. The assembly 100 sends a status message to the operator "Condition Test 3 Failure—Failure To Catch Lateral Window—Proceeding To Condition Test 4" message. The assembly 100 proceeds to Condition Test 4.

At 430, when the monitored shallow angle (<β) increases to the fully bent angle β position within a predetermined time duration, Condition Test 3 is positive. When Condition Test 3 is positive, the assembly will reposition the arm to the fully bent angle β and hold this position with a predetermined force and proceed to Condition Test 4.

At 432, the assembly 100 conducts Condition Test 4. The arm is positioned, monitored and held with a predetermined force at the fully bent angle β while the assembly 100 is run deeper in the well system 102.

At 434, when the arm position is maintained at the fully bent angle β longer than a predetermined time duration, Condition Test 4 is negative. When Condition Test 4 is negative, the assembly 100 will proceed to Condition Test 5. The assembly 100 sends a status message to the operator "Condition Test 4 Failure—Failure To Contact Open Hole Surface—Proceeding To Condition Test 5" message. The assembly 100 proceeds to Condition Test 5.

At 436, when the arm is straightened, in other words, prevented to hold the fully bent angle β for longer than a predetermined time duration, Condition Test 4 is positive. A positive Condition Test 4 indicates the arm has contacted the inner surface of the open hole wellbore. The assembly 100 straightens the arm and proceeds to Condition Test 5.

Figure 5B:
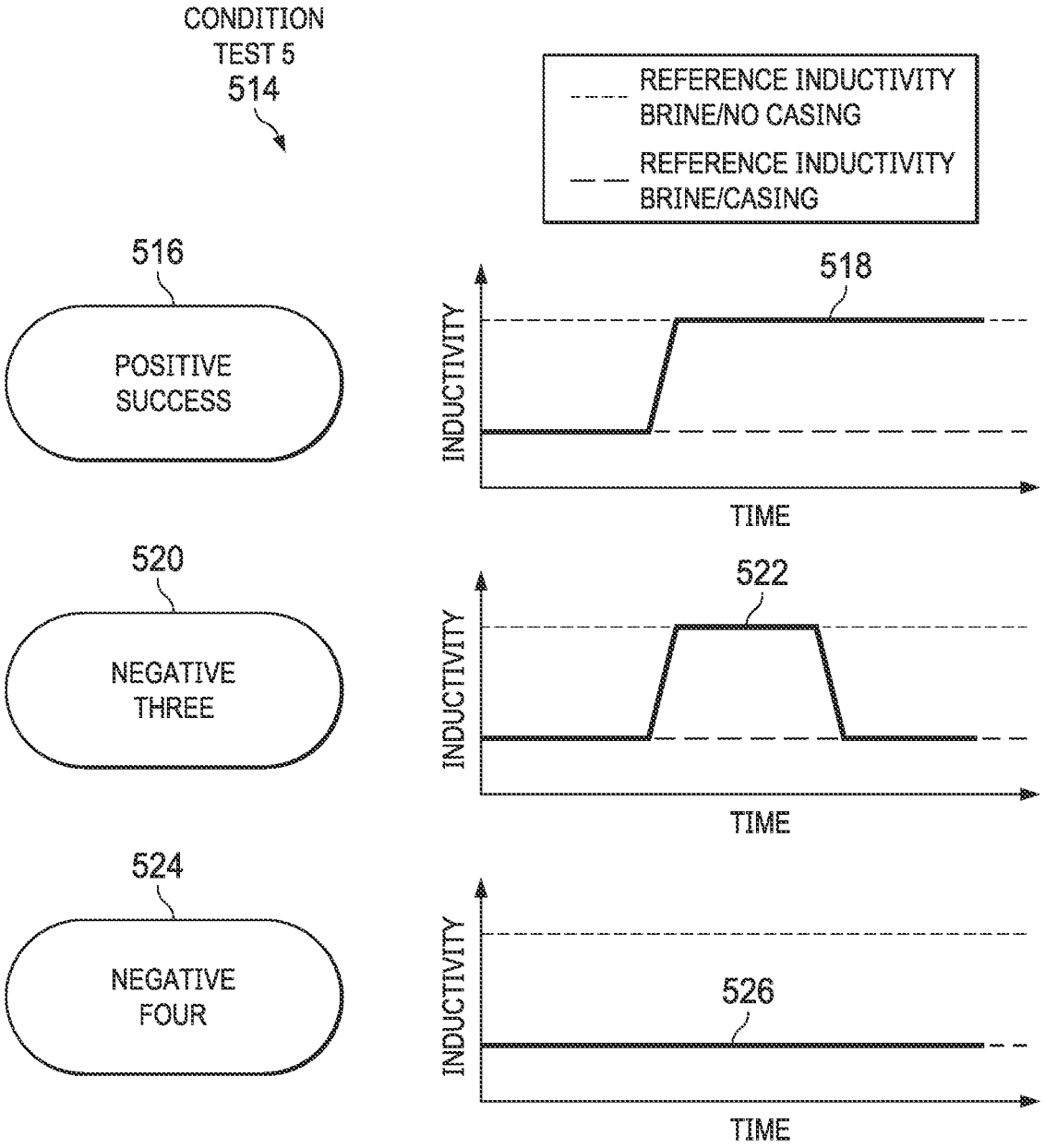
FIG. 5B is a graphical view of inductance with respect to time for the status messages of Condition Test 5 of FIG. 4.

At 438 the assembly 100 conducts Condition Test 5. The assembly 100 moves deeper into the lateral branch wellbore in a downhole direction and the second sensor senses the inductivity measurements over a predetermined time interval and transmit the signals representing the inductivity measurements to the controller. The controller compares the measurements to detect the open hole. FIG. 5B is a graphical view 514 of inductance with respect to time for the status messages of Condition Test 5 of FIG. 4

At 440, referring to FIGS. 4 and 5B, when the inductivity increases above a predetermined threshold for a predetermined duration, and then returns to the same level of inductivity 522, Condition Test 5 will be Negative 3 520 as the assembly 100 has detected a passing of the lateral window 118 and that the assembly is still in the cased hole (the metallic environment is surrounding the assembly 100). When Condition Test 5 is a Negative 3 520, the assembly 100 will deactivate, and send a status message to the operator confirming the tool has been deactivated with a corresponding error message "Condition Test 5 Failure—Tool Still In Cased Hole—Tool Deactivated" message.

At 442, referring to FIGS. 4 and 5B, when the inductivity does not increase above a predetermined threshold for a predetermined duration of time 526, Condition Test 5 will be Negative 4 524 as the assembly 100 has detected no lateral window 118 present. When Condition Test 5 is Negative 4 524, the assembly 100 deactivates and send a status message to operator confirming the tool has been deactivated with an error message "Condition Test 5 Failure—No Lateral Window Present—Tool Deactivated".

At 444, referring to FIGS. 4 and 5B, when the inductivity increases above a predetermined threshold for a predetermined second duration 518, Condition Test 5 be Positive 516 as the assembly 100 has detected a successful entry into an open hole of the lateral branch wellbore. When Condition Test 5 is Positive 516, the assembly 100 deactivates and send a status message to the operator "Successful Entry"

In some implementations, a wellbore tractor conveys the assembly 100 into and within the well system 102.

In some implementations, the assembly 100 receives instructions from the operator which is either a "Right Hand Entry" mode or a "Left Hand Entry" mode. "Right Hand Entry" positions the arm to search for the opening to the right of the assembly 100. "Left Hand Entry" positions the arm to search for the opening to the left of the assembly. The position of the opening in the wellbore is available to the operator from a directional survey and a well plan. The assembly 100 accelerometers are integrated into the control sub-assembly to form an Inertial Motion Unit (IMU), to calculate the assembly's 100 relative position in the well system 102 based on the gravity vector and the tool face orientation. Based on these inputs from the IMU, the assembly 100 uses the instructions from the operator to either position the arm to enter the lateral window 118 by a "Right Hand Entry" or a "Left Hand Entry" orientation. The IMU is used to orient an azimuth angle of the arm relative to the longitudinal axis of the assembly 100. The azimuth angle of the arm is the rotating angle when looking down the wellbore toward the assembly from a location uphole of the assembly. The IMU senses the gravitational field and generates a gravity vector corresponding to the gravitational field. The controller positions the arm at the azimuth angle in order for the arm to be able to target the location of the opening (the lateral window), which is either on the left hand side (LH) or right hand side (RH) when looking down the wellbore. Similar to step 406 above, the assembly 100 performs an IMU functional test.

First, the orientation of the assembly 100 is calculated from the gravity vector and tool face orientation. Then, the rotational position of the arm is homed (zero setting) so the assembly 100 knows the relative position of the arm to the body. Next, the assembly 100 rotates the arm about the body by the swivel joint to the direction R (Right) or L (Left), relative to tool face orientation and gravity vector measured by IMU. Fourth, the assembly 100 actuates the arm towards the inner surface of the casing and an angle is measured when a predetermined force is detected on the arm, preventing the arm to fully extend. The measured angle on the arm will be given the notation a (partially bent).

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. An assembly configured to be disposed in a well system, the well system comprising a main wellbore coupled to a lateral branch wellbore by an opening, the assembly comprising:

a body;

an arm coupled to the body, the arm configured to position the body to enter the lateral branch wellbore from the main wellbore through the opening;

an actuator sub-assembly coupled to the arm and the body, the actuator sub-assembly configured to actuate the arm relative to the body;

a control sub-assembly coupled to the body, the control sub-assembly operatively coupled to the actuator sub-assembly, the control sub-assembly comprising:

a first sensor configured to sense a condition of the arm and transmit a first signal representing the condition of the arm;

a second sensor configured to sense when the assembly is located in the main wellbore or the lateral branch wellbore and transmit a second signal representing when the assembly is located in the main wellbore or the lateral branch wellbore; and a controller configured to:

receive the first signal;

receive the second signal;

responsive to the first signal and the second signal, operate the arm relative to the body and determine when the assembly has entered the lateral branch wellbore through the opening; and a tool connector coupled to the body, the tool connector configured to couple the assembly to a tool string.

2. The assembly of claim 1, wherein:

the main wellbore comprises a casing;

the lateral branch wellbore comprises an open hole; and the opening is a lateral window.

3. The assembly of claim 1, wherein the actuator sub-assembly comprises:

a pivot joint coupling the arm to the body, the pivot joint configured to allow the arm to pivot relative to the body about the pivot joint; and a connector rod coupled to the arm and the body, the connector rod configured to shift the arm relative to the body about the pivot joint.

4. The assembly of claim 3, wherein the actuator sub-assembly further comprises:

a magnetic coupling operatively coupled to the connector rod; and a linkage rod coupled to the connector rod and the magnetic coupling, the linkage rod configured to actuate the connector rod responsive to a movement of the magnetic coupling.

5. The assembly of claim 4, further comprising a swivel coupled to the actuator sub-assembly and the body, the swivel configured to rotate the actuator sub-assembly and the arm about the body.

6. The assembly of claim 1, wherein the second sensor comprises an inductive sensor.

7. The assembly of claim 1, wherein the control sub-assembly further comprises:

one or more computer processors; and a non-transitory computer-readable storage medium storing instructions executable by the one or more computer processors to cause the one or more computer processors to perform operations comprising:

receiving the first signal from the first sensor at a first location in the well system, wherein the condition of the arm comprises a position of the arm relative to the body, the first signal comprises a value of a first position of the arm relative to the body;

storing the value of the first position in the non-transitory computer-readable storage medium;

receiving another first signal at a second location in the well system from the first sensor, wherein the condition of the arm comprises a position of the arm relative to the body, the another first signal at the second location comprising a value of a second position of the arm relative to the body;

storing the value of the second position in the non-transitory computer-readable storage medium;

receiving the second signal at the first location in the well system from the second sensor, wherein the second signal at the first location comprises a first inductance value at the first location in the well system;

storing the first inductance value in the non-transitory computer-readable storage medium;

receiving another second signal from the second sensor at the second location in the well system, wherein the second signal comprises a second inductance value at the second location in the well system;

storing the second inductance value in the non-transitory computer-readable storage medium;

wherein the instructions comprise stored values for a dimension of the well system and an inductivity of the well system;

comparing the value of the first position of the arm, the value of the second position of the arm, the first inductance value, the second inductance value and the stored values for the dimension of the well system and the inductivity of the well system; and responsive to the comparison, generating a command signal to operate the actuator sub-assembly to actuate the arm relative to the body or determine the location of the assembly in the well system.

8. The assembly of claim 7, wherein the control sub-assembly further comprises an accelerometer configured to sense a condition of the assembly, wherein a condition of the assembly includes at least one of an orientation, a position, or a motion of the assembly, the one or more computer processors are further configured to perform operations comprising:

receiving a value of a first condition of the assembly from the accelerometer at a first location in the well system;

storing the value of the first condition in the non-transitory computer-readable storage medium;

receiving a value of a second condition of the assembly from the accelerometer at a second location in the well system;

storing the value of the second condition in the non-transitory computer-readable storage medium;

comparing the value of the first condition of the assembly at the first location to the value of the second condition of the assembly at the second location; and responsive to the comparison, generating a command signal to operate the actuator sub-assembly to position or orient the assembly in the wellbore in the well system.

9. The assembly of claim 1, further comprising an arm kit comprising a plurality of arms including the arm, wherein the plurality of arms in the arm kit have different lengths.

10. The assembly of claim 1, further comprising a wireless communications sub-assembly coupled to the control sub-assembly, the wireless communications sub-assembly configured to:

receive a command signal from an operating station, the command signal representing a tool activate command or a tool deactivate command; and transmit a status signal to the operating station, the status signal representing a condition of the assembly.

11. A method comprising:

carrying, into a well system comprising a main wellbore and a lateral branch wellbore connected to the main wellbore by a lateral window, by a downhole conveyor, a body coupled to an arm configured to position the body to enter the lateral window, the body and the arm coupled to an actuator sub-assembly configured to actuate the arm relative to the body;

actuating, by the actuator sub-assembly, the arm to contact an inner surface of the main wellbore;

moving, by the body, the arm along the inner surface of the main wellbore from a first location toward the lateral window until the arm contacts the lateral window at a second location;

receiving, by a controller connected to the body, the arm, and the actuator, a first signal at the first location and another first signal at the second location representing a position of the arm relative to the body and a second signal at the first location and another second signal at the second location representing when the assembly is located in either the main wellbore or the lateral wellbore branch;

comparing, by the controller, a value of the first signal at the first location in the well system and a value of the second signal at the first location in the well system to a value of the first signal at the second location in the well system and a value of the second signal at the second location in the well system and a characteristic of the well system;

responsive to the comparison indicating the arm has entered the lateral window, actuating, by the actuator sub-assembly, the arm to position the body to enter the lateral window; and moving the arm and the body into the lateral window.

12. The method of claim 11, further comprising:

before moving the body into the lateral window, sensing a first condition of the well system;

transmitting a first signal representing the first condition of the well system to the controller;

after moving the body into the lateral window, sensing a second condition of the well system;

transmitting a second signal representing the second condition of the well system to the controller;

comparing, by the controller, the first signal to the second signal; and responsive to the comparison, determining when the body enters the lateral window.

13. The method of claim 12, wherein:

the second signal representing when the assembly is located in a casing or an open hole comprises sensing, by an inductive sensor, a well system inductance; and the first condition of the well system and the second condition of the well system comprise a first well system inductance and a second well system inductance, respectively, the method further comprises:

sensing the first well system inductance indicates the body is in a casing of the well system; and sensing the second well system inductance indicates the arm and the body has passed through the lateral window and into an open hole lateral of the well system.

14. The method of claim 12, wherein actuating, by the actuator sub-assembly, the arm to position the body to enter the lateral window comprises:

sliding a linkage rod operatively coupled to the arm;

responsive to sliding the linkage rod, actuating a connector rod, the connector rod coupled to the linkage rod; and responsive to actuating the connector rod, shifting the arm relative to the body about a pivot joint coupling the arm to the body, the pivot joint configured to allow the arm to pivot relative to the body about the pivot joint, the arm shifting to contact to the inner surface of the well system.

15. The method of claim 14, wherein actuating, by the actuator sub-assembly, the arm to position the body to enter the lateral window further comprises, before sliding the linkage rod:

energizing, by the controller, a magnetic coupling operatively coupled to the linkage rod;

responsive to energizing the magnetic coupling, sliding the magnetic coupling within the actuator sub-assembly; and responsive to sliding the magnetic coupling, sliding the linkage rod.

16. The method of claim 15, further comprising while simultaneously moving the arm along the inner surface of the main wellbore toward the lateral window, rotating, by a swivel, the arm to contact the lateral window, the swivel coupled to the actuator sub-assembly and the body, the swivel configured to rotate the actuator sub-assembly and the arm about the body.

17. The method of claim 12, wherein the body is carried into the well system by a downhole conveyor, the method further comprises:

carrying, wherein the downhole conveyor comprises an acid stimulation coiled tubing assembly, the downhole conveyor into the lateral branch wellbore through the lateral window; and flowing a fluid comprising an acid, by the acid stimulation coiled tubing assembly, into the lateral branch wellbore.

18. A method implemented in a well system, the method comprising:

carrying, by a controller, into the well system, the well system comprising a main wellbore comprising a casing and a lateral branch wellbore comprising an open hole connected to the main wellbore by a lateral window, a body coupled to an arm configured to position the body to enter the lateral branch wellbore through the lateral window, the body and the arm coupled to an actuator sub-assembly configured to actuate the arm relative to the body;

actuating, by the controller, the arm relative to the body to a first position, wherein when the arm is in the first position the arm is in contact with an inner surface of the casing;

moving, by the controller, the arm along the inner surface of the casing toward the lateral window;

receiving, by the controller, from a first sensor coupled to the controller, the first sensor configured to sense a position of the arm relative to the body, the arm moving from the first position to a second position, wherein moving from the first position to the second position indicates the arm has entered the lateral branch wellbore through the lateral window and the arm is in contact with an inner surface of the lateral branch wellbore, a signal representing that the arm has entered the lateral branch wellbore through the lateral window and the arm is contacting an inner surface of the lateral branch wellbore;

responsive to receiving the signal representing that the arm has entered the lateral branch wellbore through the lateral window and the arm is contacting an inner surface of the lateral branch wellbore, actuating, by the controller, the arm to maintain contact with the inner surface of the lateral wellbore branch;

receiving, by the controller, from the first sensor, a signal representing the arm has actuated to a third position, wherein the third position indicates the arm is fully bent relative to the body in the lateral wellbore branch, actuating, by the controller, the arm to a fourth position relative to the body, wherein the fourth position is a partially bent position to not contact the inner surface of the lateral wellbore branch with the arm while maintaining the arm in the lateral window;

moving, by the controller, the arm in the lateral window;

receiving, by the controller, the signal representing the arm has moved to the third position when the arm was moved to the third position by contacting an edge of the lateral window; and moving, by the controller, the arm and the body into the lateral branch wellbore through the lateral window by contacting the arm, while in the third position, to the edge of the lateral window to force the body through the lateral window and into the lateral branch wellbore.

19. The method of claim 18, after receiving the signal representing the arm has moved to a third position when the arm was moved to the third position by contacting the edge of the lateral window, the method further comprises holding the arm locked at the third position by the actuation sub-assembly.

20. The method of claim 19, after moving the arm and the body into the lateral branch wellbore through the lateral window, the method further comprises:

receiving, by the controller, from the first sensor, a signal representing that the arm has moved from the third position to the fourth position, wherein the arm moving from the third position to the fourth position indicates the arm has contacted the inner surface of the lateral branch wellbore; and responsive to receiving the signal representing that the arm has moved from the third position to the fourth position, actuating the arm to a fifth position relative to the body, wherein the fifth position is a straight position to align the arm with the body.

21. The method of claim 18, further comprising:

receiving, by the controller, from an inductive sensor coupled to the controller, the inductive sensor configured to sense an inductance in the well system and transmit a signal representing the inductance to the controller, a first signal representing a first value of a first inductance at a first location in the well system;

receiving, by the controller, a second signal representing a second value of a second inductance at a second location in the well system;

comparing, by the controller, the first value to the second value; and determining, by the comparison of the first value to the second value, when the arm and the body are in the casing of the main wellbore or in the open hole of the lateral branch wellbore, wherein when the second value is the same as the first value, the arm and the body are in the casing of the main wellbore, and wherein when the second value is greater than the first value, the arm and the body are in the open hole of the lateral branch wellbore.

22. The method of claim 18, further comprising flowing, by the controller, wherein an acid stimulator tool is coupled to the body, a fluid comprising an acid from the acid stimulator tool into the lateral branch wellbore.

* * * * *